US006649853B2

(12) United States Patent
Takagi et al.

(10) Patent No.: US 6,649,853 B2
(45) Date of Patent: Nov. 18, 2003

(54) COMBINED TYPE FLUID PRESSURE DRIVING APPARATUS

(75) Inventors: Hirokazu Takagi, Yokohama (JP); Yoshikata Kobayashi, Hachiouji (JP); Fumio Nakajima, Yokohama (JP); Tsutomu Tanaka, Yokohama (JP); Masaharu Shimizu, Yokohama (JP); Akio Kobayashi, Yokohama (JP); Hiroshi Furuta, Yokohama (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 0 days.

(21) Appl. No.: 10/000,169

(22) Filed: Dec. 4, 2001

(65) Prior Publication Data

US 2002/0066719 A1 Jun. 6, 2002

(30) Foreign Application Priority Data

Dec. 5, 2000 (JP) ..... 2000-370463

(51) Int. Cl.[7] ..... H01H 33/14
(52) U.S. Cl. ..... 218/7; 218/78; 218/84
(58) Field of Search ..... 218/43, 45, 2, 218/7, 14, 152–154, 80, 84, 92, 120, 140, 67; 200/82 B

(56) References Cited

U.S. PATENT DOCUMENTS 3,823,286 A * 7/1974 Thurk et al. ..... 200/82 B
4,365,126 A * 12/1982 Oshima et al. ..... 218/143

* cited by examiner

*Primary Examiner*—Anh Mai
*Assistant Examiner*—M. Fishman
(74) *Attorney, Agent, or Firm*—Oblon, Spivak, McClelland, Maier & Neustadt, P.C.

(57) ABSTRACT

The present invention provides a switchgear, which can achieve miniaturization and simplification while securing high operation reliability, and excellent in assembly, operability and inspection, and further, has a compact size. A fluid pressure operating section is provided in a mechanical box arranged on a lower end portion of a support porcelain tube. Insulated operating rods are received in the support porcelain tube, and connecting mechanisms are received in a container. Switching contacts of circuit breaker and disconnecting switches and the fluid pressure operating section are connected via the connecting mechanisms and the insulated operating rods.

15 Claims, 15 Drawing Sheets

COMBINED TYPE FLUID PRESSURE DRIVING APPARATUS

BACKGROUND OF THE INVENTION

1. Field of the Invention

The present invention relates to a fluid pressure driving apparatus for switching a contact of gas insulated switchgear, and in particular, to a combined type fluid pressure driving apparatus for driving a circuit breaker and a disconnecting switch.

2. Description of the Related Art

In recent years, a gas insulated switchgear has been mainly used in switchgear for electric power. The gas insulated switchgear is constructed in a manner that many switches are arranged in a metal housing container filled with an insulating gas. Various type of switchgears have been proposed such that a gas insulated disconnecting switch is interposed between a power circuit breaker and any two busbars, between two busbars, between the power circuit breaker and a grounding contact or between the power circuit breaker and a power transmission system.

The typical conventional gas insulated switchgear has been disclosed in U.S. Pat. No. 5,841,087, and a disconnecting switch of the gas insulated switchgear will be described below with reference to FIG. 14 and FIG. 15. FIG. 14 is a front sectional view showing a conventional gas insulated disconnecting switch, and FIG. 15 is a side sectional view taken along a line B—B of FIG. 14.

As shown in FIG. 14, a disconnecting switch 200 is received in a grounding metal container 201, which is filled with an insulating gas, e.g., $SF_6$ gas. An upper portion of the grounding metal container 201 is formed with first and second attachment flanges 203 and 204, and a first stationary electrode 205 is fixed to the first attachment flange 203 via an insulating spacer. Likewise, a second stationary electrode 206 is fixed to the second attachment flange 204. Namely, these stationary electrodes 205 and 206 are fixed in a state of being electrically insulated from the grounding metal container 201.

Further, as shown in FIG. 15, a lower portion of the grounding metal container 201 is formed with a third attachment flange 208, and a side portion thereof is formed with a fourth attachment flange 209. A third stationary electrode 210 electrically connected to the grounding metal container 201 is fixed to the third attachment flange 208, and a metallic cover 211 is attached to the fourth attachment flange 209. A hollow insulating cylinder 212 extending toward the grounding metal container 201 is fixed to the cover 211, and a drive shaft 213 is inserted into a hollow portion of the insulating cylinder 212. The drive shaft 213 is extended from the outside of the grounding metal container 201 to the inside thereof, and penetrates through the cover 211 while airtightly keeping the insulating gas.

In FIG. 14 and FIG. 15, first to third cylindrical movable electrodes 215 to 217 individually pair with the first to third stationary electrodes 205, 206 and 210 so that first to third contacts 218 to 220 are formed. Further, the movable electrodes 215 to 217 are electrically connected to a current terminal 223 by current application via a sliding contact (not shown) and a shielding element container 222.

The current terminal 223 is connected with another switching device, e.g., a circuit breaker. A main bus conductor is connectable to the stationary electrode insulated from the grounding metal container 201, that is, the first and second stationary electrodes 205 and 206. Thus, the first and second contacts 218 and 219 perform a function as busbar or main bus line select disconnecting switch. Further, the third stationary electrode 210 making short-circuit with the grounding metal container 201 has a ground potential; therefore, the third contact 220 functions as a ground system.

By the way, a gearbox 225 for making a switching operation of the contacts 218 to 220 is received in the metal container 222. The gearbox 225 includes first to third cams 226, 230 and 233, and first to sixth levers 227, 228, 231, 232, 234 and 235. More specifically, the first cam 226 is connected to the first movable electrode 215, and the first and second levers 227 and 228 are arranged so as to hold the first cam 226 between them. The second cam 230 is connected to the second movable electrode 216, and the third and fourth levers 231 and 232 are arranged so as to hold the second cam 230 between them. The third cam 233 is connected to the third movable electrode 217, and the fifth and sixth levers 234 and 235 are arranged so as to hold the third cam 233 between them.

Further, the gearbox 225 drives three movable electrodes, that is, first to third movable electrodes 215 to 217 so as to separate and close the paired first to third stationary electrodes 205, 206 and 210, and thereby, makes the switching operation of the first to third contacts 218 to 220.

The first movable electrode 215 is connected with the first cam 226, and the paired first and second levers 227 and 228 are fixed to the drive shaft 213 at an angle different from each other so as to convert a rotating motion of the drive shaft 213 into a reciprocating motion. Further, the levers 227 and 228 of the first cam 226 are individually provided with a pin at their distal end portion. Both sides of the first cam 226 are formed with a circular-arc groove, and the pin of each distal end of the levers 227 and 228 is slidably inserted into the above groove.

The first cam 226 constructed as described above functions as a cam mechanism for converting a rotary driving force of the drive shaft 213 into a linear reciprocating motion. Therefore, the first cam 226 converts a rotary driving force of the drive shaft 213 into a linear reciprocating motion, and then, transmits it to the first movable electrode 215. When the rotary driving force is transmitted to the first movable electrode 215, the first movable electrode 215 makes a linear reciprocating motion so as to carry out a switching operation of the first contact 218.

In this case, the first cam 226 is formed with a thin and long slot 236 (as shown in FIG. 14) having a width such that the drive shaft 213 can pass through there. The drive shaft 213 passes through the slot 236, and thereby, this performs a function as one fulcrum for the linear reciprocating motion of the first cam 226.

On the other hand, the second and third movable electrodes 216 and 217 include the same cam mechanism as the above-mentioned first movable electrode 215, and make the same linear reciprocating motion.

The gearbox 225 is rotated when a driving force is transmitted to the drive shaft 213 from an operating mechanism section (not shown) arranged at the outside of the grounding metal container 201 in the drive shaft 213 of the disconnecting switch 200. The above operating mechanism section and the gearbox 225 constitute a driving system for switching and driving the first to third contacts 218 to 220.

In the conventional driving apparatus, the first to third contacts 218 to 220 are switched and driven by the driving system including the operating mechanism section and the gearbox 225. More specifically, when the operating mechanism section is driven, the drive shaft 213 of the gearbox 225 is rotated by receiving the driving force, and then, the first lever 227 to the sixth lever 235 are rotated with the rotation.

Then, each distal pin of the rotating first and second levers 227 and 228 moves along the cam groove of the first cam 226. Likewise, each distal pin of the rotating third and fourth levers 231 and 232 moves along the cam groove of the second cam 230, and further, each pin of the rotating fifth and sixth levers 234 and 235 moves along the cam groove of the third cam 233.

The first lever 227 to the sixth lever 235 and the first cam 226 to the third cam 233 interact with each other, and thereby, it is possible to convert the rotating motion of the drive shaft 213 into a linear reciprocating motion. The rotary driving force of the drive shaft 213 thus converted is transmitted to the first to third movable electrodes 215 to 217.

By the driving force thus transmitted, the first movable electrode 215 moves to the axial direction so as to make a switching operation of the first contact 218. Likewise, the second movable electrode 216 moves to the axial direction so as to make a switching operation of the second contact 219, and further, the third movable electrode 217 moves to the axial direction so as to make a switching operation of the third contact 220.

The gearbox 225 included in the disconnecting switch has been described above. However, in the conventional driving apparatus, the driving apparatus is required for a circuit breaker existing outside the figure. Thus, there is a need of providing an independent driving apparatus for each contact of apparatuses such as disconnecting switch and circuit breaker; as a result, the driving apparatus has been made into a large size. For this reason, the gas insulated switchgear is inevitably made into a large size. More specifically, in the above gearbox 225, one cam and two levers are required with respect to one movable electrode; as a result, the number of components is increased. Further, the number of components is increased; as a result, the structure becomes complicate, and manufacture assembly cost becomes high; therefore, this is disadvantageous in economization.

Moreover, when the number of components is increased, the apparatus configuration becomes complicate, and further, a space for receiving the gearbox 225 must be widened. More specifically, the metal container 222 for receiving the gearbox 225 and the grounding metal container 201 of the disconnecting switch 200 are made into a large size; as a result, the driving apparatus and the gas insulated switchgear are also made into a large size. When the apparatus is made into a large size, the cost is high; therefore, this is disadvantageous in economization.

In addition, in the driving apparatus, it is extremely important to secure an operation reliability. Thus, in order to secure the operation reliability, there is a need of assembling the complicate apparatus with high precision. However, when the number of components is increased, the apparatus configuration becomes complicate, and further, a work for assembling the driving apparatus becomes complicate; as a result, the work efficiency is reduced. Meanwhile, in the operation, maintenance and inspection, in the case where the apparatus configuration is complicate, the disassembling work for maintenance and inspection becomes complicate; as a result, there is a possibility of reducing the operability, maintenance and inspection performance when the apparatus is actually used.

SUMMARY OF THE INVENTION

The present invention has been made in view of the problems in the prior art. Accordingly, an object of the present invention is to provide a combined type fluid pressure driving apparatus, which can achieve small integration and simplification while securing high operation reliability, and has a switch made into a compact size.

Another object of the present invention is to provide a combined type fluid pressure driving apparatus, which is excellent in assembly, operation maintenance and inspection performance.

In order to achieve the above object, according to one aspect, the present invention provides a combined type fluid pressure driving apparatus comprising:

a metal container including a hollow support porcelain tube and a plurality of receiving porcelain tubes;

each contact of circuit breaker and disconnecting switch having a stationary electrode fixed in each of the receiving porcelain tubes, and a movable electrode received so as to freely separate from and close to the stationary electrode;

an insulating gas sealed in the metal container, the support porcelain tube and the receiving porcelain tube;

an insulated operating rod operated in the support porcelain tube;

a mechanical box arranged on the other end of the support porcelain tube;

a fluid pressure operating device received in the mechanical box and driven by fluid pressure; and a connecting mechanism section provided in the metal container, an operating force of the fluid pressure operating device being transmitted from the insulated operating rod to the movable electrode via the connecting mechanism section so that each contact of the circuit breaker and the disconnecting switch is switched (opened and closed).

In order to achieve the above object, according to another aspect, the present invention provides the combined type fluid pressure driving apparatus, wherein the fluid pressure operating device includes:

a plurality of fluid pressure cylinders switching and driving each switching contact of the circuit breaker and the disconnecting switch in accordance with feed and discharge of high-pressure fluid;

a plurality of fluid pressure control valves for independently driving each of the fluid pressure cylinders;

an accumulator for storing a high-pressure working fluid supplied to a plurality of fluid pressure cylinders and fluid pressure control valves;

a pump for supplying the high-pressure working fluid into the accumulator; and a low-pressure tank for storing a low-pressure fluid discharged from the fluid pressure cylinders.

According to the above invention, a fluid pressure driving method is employed for readily achieving high output by high pressure, and therefore, it is possible to make compact the fluid pressure cylinder and the fluid pressure control valve, which are principal components of the fluid pressure operating device. Further, the accumulator, the pump and the low-pressure tank required for the drive are used in common between different apparatuses and the fluid pressure operating device. By doing so, it is possible to greatly reduce the number of components, and to achieve a simplification of structure.

In order to achieve the above object, according to another aspect, the present invention provides the combined type fluid pressure driving apparatus, wherein the fluid pressure operating device further includes: a circuit-breaker fluid pressure operating section for switching and driving a contact of the circuit breaker; a disconnecting-switch fluid pressure operating section for switching and driving a contact of the disconnecting switch; and a manifold forming the fluid pressure cylinder at the circuit-breaker fluid pressure operating section, and the manifold is removably attached with the accumulator, the pump, the low-pressure tank and the disconnecting-switch fluid pressure operating section.

According to the above invention, members such as the accumulator, the pump and the low-pressure tank, which are used in common between the circuit-breaker fluid pressure operating section and two disconnecting-switch fluid pressure operating section, are attached to the manifold of the circuit-breaker fluid pressure operating section side. Therefore, there is no need of providing connective pipe required for connecting two fluid pressure operating sections, and this contributes to integral combination of the driving apparatus. As a result, a design for saving a space is possible, and the driving apparatus can be made compact. Further, the member attached to the manifold of the circuit-breaker fluid pressure operating section is freely removable, so that a disassembling work for inspection can be simply carried out, and maintenance and inspection performance can be improved.

In order to achieve the above object, according to another aspect, the present invention provides the combined type fluid pressure driving apparatus, wherein the fluid pressure operating device includes: a circuit-breaker fluid pressure operating section for switching and driving a contact of the circuit breaker; a disconnecting-switch fluid pressure operating section for switching and driving a contact of the disconnecting switch, and the circuit-breaker fluid pressure operating section the disconnecting-switch fluid pressure operating section are connected with each other via a fluid pipe.

According to the above invention, in accordance with the layout of the plural contacts constituting the switchgear, a part or all of the disconnecting-switch fluid pressure operating section is arranged on the position far from the circuit-breaker fluid pressure operating section. In Such a case, the disconnecting-switch fluid pressure operating section and the circuit-breaker fluid pressure operating section are merely connected using pipe; therefore, it is possible to sufficiently secure a degree of freedom in design. Further, the accumulator, the pump and the low-pressure tank are used in common, and therefore, the fluid pressure driving apparatus can be made compact by integral combination.

In order to achieve the above object, according to another aspect, the present invention provides the combined type fluid pressure driving apparatus, wherein the apparatus is provided with a piston holding mechanism, which holds a position of fluid pressure piston sliding in each of fluid pressure cylinders when the high-pressure working fluid of the accumulator is lost.

According to the above invention, when the high-pressure working fluid of the accumulator is lost, the lock mechanism is operated so as to hold the position of the fluid pressure piston; therefore, it is possible to securely hold the switching state of contact. By doing so, it is possible to improve safety and reliability of the apparatus.

In order to achieve the above object, according to another aspect, the present invention provides the combined type fluid pressure driving apparatus, wherein the driving apparatus further includes: a driving rod extending from a fluid pressure piston fixed integrally with a flange; an expansible rod mechanism for expansibly connecting a support member fixed in the mechanical box with the flange; and an elastic element for elastically holding a position of the fluid pressure piston by an operating rod of the expansible rod mechanism.

According to the above invention, the making and breaking position of the fluid pressure piston is securely held by a load of compression spring regardless of the fluid pressure. Further, it is possible to visibly confirm the switching state of contact from the outside; therefore, inspection can be readily made.

In order to achieve the above object, according to another aspect, the present invention provides the combined type fluid pressure driving apparatus, wherein the driving rod extending from the fluid pressure piston and a support bracket fixed in the mechanical box are individually formed with an attachment hole aligned with each other, and a lock pin is inserted into the aligned, and thereby, a mechanism for holding the position of the fluid pressure piston is constructed.

According to the above invention, the lock pin is merely inserted into the hole of driving rod extending from the fluid pressure piston sliding in the fluid pressure cylinder, and thereby, the position of the fluid pressure piston can be held, and therefore, it is possible to carry out a work for holding the position of the fluid pressure piston by manual. Further, it is possible to visibly confirm the inspection, and thus, to improve safety and reliability.

In order to achieve the above object, according to another aspect, the present invention provides the combined type fluid pressure driving apparatus, wherein the fluid pressure operating device includes: a circuit-breaker fluid pressure operating section for switching and driving a contact of the circuit breaker; and a disconnecting-switch fluid pressure operating section for switching and driving a contact of the disconnecting switch, and a piston rod extending from the fluid pressure piston of the disconnecting-switch fluid pressure operating section is slidable, and a cylinder head fixed to one end of the fluid pressure cylinder is arranged in the gearbox, and further, the cylinder head is attached with a fluid pressure control valve.

According to the above invention, the constituent components are arranged so as to centralize in the cylinder head of the disconnecting-switch fluid pressure operating section, and therefore, the other end of the fluid pressure cylinder may be attached with only member for sealing a working fluid, and the structure can be simplified. Further, a relatively heavy constituent component such as the fluid pressure control valve is arranged on the position near to the upper fixed point. Therefore, it is possible to realize a structure, which is durable to an external force such as vibration by the operation and vibration by the operation of the circuit-breaker fluid pressure operating section having a relatively large driving force, and is excellent in vibration proofing and strength. In particular, the lower end portion of the circuit-breaker fluid pressure operating section opposite to the cylinder head is light; therefore, the fluid pressure cylinder is readily attached in the horizontal direction, and there is no limitation in the attachment direction. As a result, a degree of freedom increases in the layout.

In order to achieve the above object, according to another aspect, the present invention provides the combined type fluid pressure driving apparatus, wherein the fluid pressure operating device includes: a circuit-breaker fluid pressure operating section for switching and driving a contact of the circuit breaker; and a disconnecting-switch fluid pressure operating section for switching and driving a contact of the disconnecting switch, and an outer cylinder is concentrically arranged on an outer side of the fluid pressure cylinder of the disconnecting-switch fluid pressure operating section so as to form a double cylindrical structure, and further, an annular gap between the double cylindrical structure is used as a control fluid passage for feeding and discharging a high-pressure working fluid to and from a cylinder chamber of the fluid pressure cylinder.

According to the above invention, the control fluid passage is provided coaxially with the fluid pressure cylinder; therefore, this is advantageous to simplify the structure and to save a space as compared with the case where the fluid passage is arranged separately.

In order to achieve the above object, according to another aspect, the present invention provides the combined type fluid pressure driving apparatus, wherein the fluid pressure operating device includes: a circuit-breaker fluid pressure operating section for switching and driving a contact of the circuit breaker; and a disconnecting-switch fluid pressure operating section for switching and driving a contact of the disconnecting switch, and the fluid pressure cylinder of the disconnecting-switch fluid pressure operating section is attached to the cylinder head fixed in the mechanical box, and further, the fluid pressure control valve is arranged on the side opposite to the fluid pressure cylinder.

According to the above invention, the lower end portion of the circuit-breaker fluid pressure operating section needs to attach a member for sealing a working fluid, and the valve block of the fluid pressure control valve is used in common as the member, and thereby, it is possible to reduce the number of components, and thus, to simplify the structure. Further, the valve block is arranged on the cylindrical section of the fluid pressure cylinder; therefore, it is possible to make a design for making compact the driving apparatus without projecting the member into the radius direction.

In order to achieve the above object, according to another aspect, the present invention provides the combined type fluid pressure driving apparatus, wherein the fluid pressure operating device includes: a circuit-breaker fluid pressure operating section for switching and driving a contact of the circuit breaker; and a disconnecting-switch fluid pressure operating section for switching and driving a contact of the disconnecting switch, and one end of the fluid pressure cylinder of disconnecting-switch fluid pressure operating section is attached to the cylinder head fixed in the mechanical box, and the fluid pressure control valve is provided on the side opposite to the fluid pressure cylinder while an outer cylinder is concentrically arranged on an outer side of the fluid pressure cylinder of the disconnecting-switch fluid pressure operating section so as to form a double cylindrical structure, and further, an annular gap between the double cylindrical structure is used as a high-pressure fluid passage for always supplying a high-pressure fluid from the accumulator to the cylinder chamber of the fluid pressure cylinder.

According to the above invention, the high-pressure fluid passage is provided coaxially with the fluid pressure cylinder, and therefore, this is advantageous to simplify the structure and to save a space as compared with the case where the fluid passage is arranged separately.

In order to achieve the above object, according to another aspect, the present invention provides the combined type fluid pressure driving apparatus, wherein the fluid pressure operating device includes: a circuit-breaker fluid pressure operating section for switching and driving a contact of the circuit breaker; and a disconnecting-switch fluid pressure operating section for switching and driving a contact of the disconnecting switch, and a piston rod extending from the fluid pressure piston of the disconnecting-switch fluid pressure operating section is slidable, and a cylinder head fixed to the fluid pressure cylinder is fixed in the mechanical box, and further, the cylinder head is attached with a fluid pressure control valve so that an operating axis of the fluid pressure control valve and an operating axis of the fluid pressure piston are perpendicular to each other.

According to the above invention, an external force such as vibration by the operation of the fluid pressure piston and vibration by the operation and vibration by the operation of the circuit-breaker fluid pressure operating section having a relatively large driving force acts to the operating axis direction of the fluid pressure piston. In such a case, it is possible to prevent an erroneous operation of the fluid pressure control valve, and thus, to realize the structure, which is excellent in reliability.

In order to achieve the above object, according to another aspect, the present invention provides the combined type fluid pressure driving apparatus, wherein the fluid pressure operating device includes: a circuit-breaker fluid pressure operating section for switching and driving a contact of the circuit breaker; and a disconnecting-switch fluid pressure operating section for switching and driving a contact of the disconnecting switch, and at least one or more switching valve is provided on the midway of high-pressure and low-pressure fluid passages for connecting the circuit-breaker fluid pressure operating section with the disconnecting-switch fluid pressure operating section.

In order to achieve the above object, according to another aspect, the present invention provides the combined type fluid pressure driving apparatus, wherein the fluid pressure operating device includes: a circuit-breaker fluid pressure operating section for switching and driving a contact of the circuit breaker; and a disconnecting-switch fluid pressure operating section for switching and driving a contact of the disconnecting switch, and the high-pressure and low-pressure fluid passages for connecting the circuit-breaker fluid pressure operating section with the disconnecting-switch fluid pressure operating section are formed of a flexible pipe, and further, a connector with at least one or more check valve is provided on the midway thereof.

In order to achieve the above object, according to another aspect, the present invention provides the combined type fluid pressure driving apparatus, wherein the fluid pressure operating device includes: a circuit-breaker fluid pressure operating section for switching and driving a contact of the circuit breaker; and a disconnecting-switch fluid pressure operating section for switching and driving a contact of the disconnecting switch, and the circuit-breaker fluid pressure operating section or the disconnecting-switch fluid pressure operating section is connectable with an auxiliary fluid pressure source including at least one or more electrically-operated or manual pump.

In order to achieve the above object, according to another aspect, the present invention provides the combined type fluid pressure driving apparatus, wherein the fluid pressure operating device includes: a circuit-breaker fluid pressure operating section for switching and driving a contact of the circuit breaker; and a disconnecting-switch fluid pressure operating section for switching and driving a contact of the disconnecting switch, and the circuit-breaker fluid pressure operating section or the disconnecting-switch fluid pressure operating section includes an auxiliary fluid pressure source including at least one or more electrically-operated or manual pump, and the an auxiliary fluid pressure source is provided with an electrically-operated or manual pump, an accumulator for storing a high-pressure fluid and an auxiliary tank for storing a low-pressure fluid.

According to the above invention, even if the fluid pressure of the combined type fluid pressure driving apparatus is reduced, it is possible to provide the combined type fluid pressure driving apparatus, which can readily perform various works such as inspection and repair of the fluid pressure operating section, replacement work and recovery work of fluid pressure without stopping the transmission line.

DESCRIPTION OF THE PREFERRED EMBODIMENTS

Preferred embodiments of combined type fluid pressure driving apparatus according to the present invention will be described below with reference to the accompanying drawings.

[First embodiment]

A first embodiment of the combined type fluid pressure driving apparatus according to the present invention will be described below with reference to FIG. 1 to FIG. 4.

Figure 1:
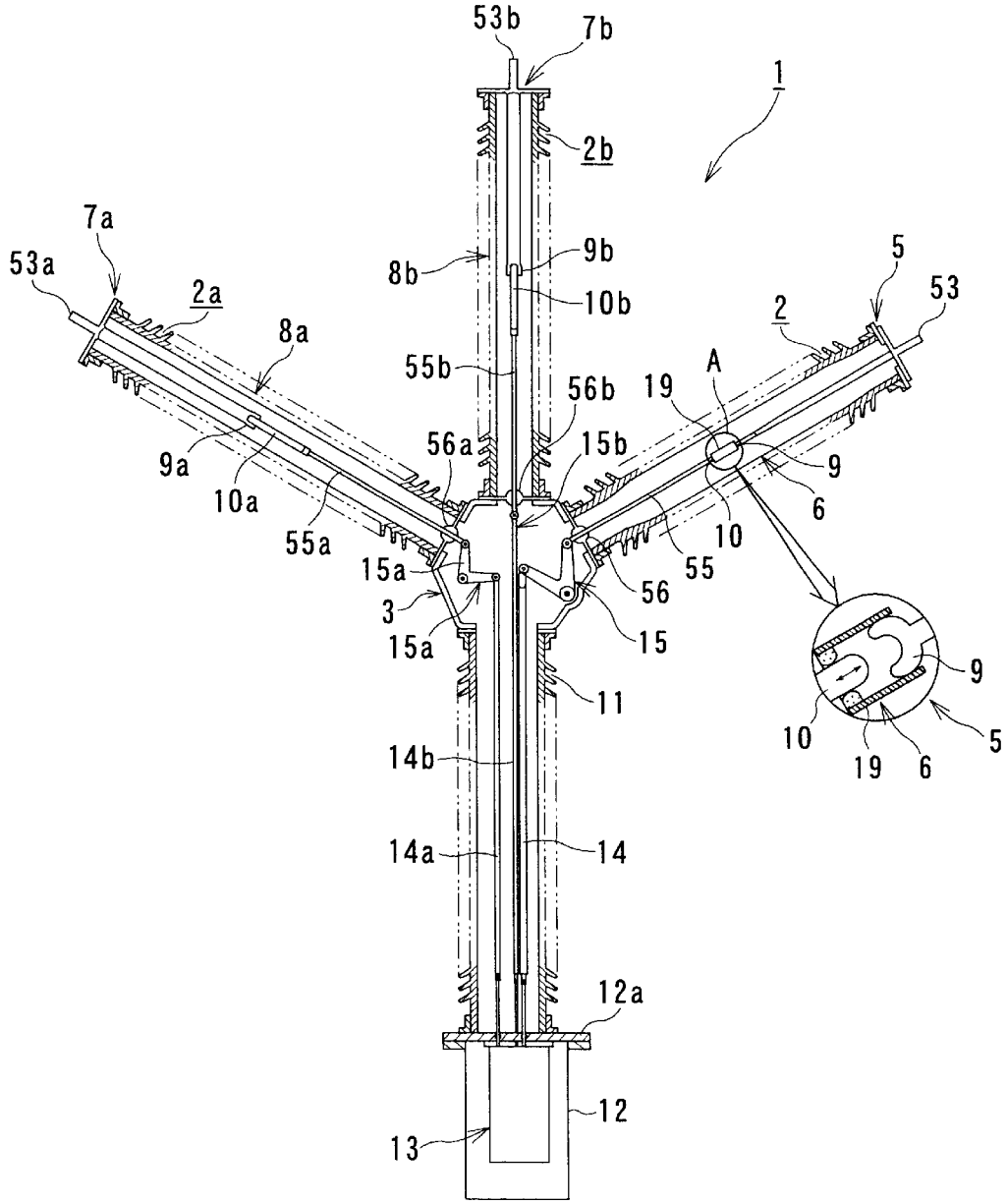
FIG. 1 is a view showing a combined type fluid pressure driving apparatus according to a first embodiment of the present invention.

FIG. 1 is a view showing a combined type fluid pressure driving apparatus or hydraulic driving apparatus according to a first embodiment of the present invention. The combined type fluid pressure driving apparatus is applied to an insulating switch 1 used as gas insulated switchgear. The insulting switch 1 can produce connections between two of a plurality of any desired system components or disconnect these connections. The insulting switch 1 is applied to switch and drive an electric transmission line or power circuit of 100 MV~500 MV, more preferably 100 MV~300 MV.

The insulating switch 1 includes plural, e.g., three receiving porcelain tubes 2, 2*a* and 2*b*, which are filled with an insulating gas, such as for example $SF_6$ or gaseous nitrogen. These receiving porcelain tubes 2, 2*a* and 2*b* are individually formed of an insulating material such as insulator, and are fixed and held in a state of being attached to a metal container or housing 3 used as a main body case, which is formed of conductive metal material such as for example aluminum or aluminum alloy. In this case, these receiving porcelain tubes 2, 2*a* and 2*b* are attached to the metal container 3 at a predetermined angle. Of these receiving porcelain tubes 2, 2*a* and 2*b*, that is, the receiving porcelain tube 2 receives a contact 6 of circuit breaker 5, while other receiving porcelain tubes 2*a* and 2*b* receive first and second contacts 8*a* and 8*b* of disconnecting switches 7*a* and 7*b*, respectively. The contacts 6, 8*a* and 8*b* received in the receiving porcelain tubes 2, 2*a* and 2*b* are composed of stationary electrodes or fixed switching elements 9, 9*a* and 9*b* fixed to the distal end portion of the receiving porcelain tubes 2, 2*a* and 2*b* and movable electrodes or movable switching elements 10, 10*a* and 10*b*, respectively. These movable electrodes 10, 10*a* and 10*b* are individually received so as to freely separate from and close to the stationary electrodes 9, 9*a* and 9*b*.

On the other hand, the metal container 3 is attached to an upper end portion of a hollow support porcelain tube 11, and an insulting gas is sealed between the container 3 and the support porcelain tube 11. The lower end portion of the support porcelain tube 11 is provided with a mechanical box 12, such as gearbox. The gearbox 12 is provided with a fluid pressure operating device 13, which is driven by fluid pressure of working fluid, such as for example working mineral oil (MIL 5606) which has a low viscosity change by temperature.

Further, the support porcelain tube 11 receives insulated operating rods 14, 14*a* and 14*b*, which are driven by the fluid pressure operating device 13. These operating rods 14, 14*a* and 14*b*, which are formed of a fiber reinforced material, such as for example glass fiber reinforced material or fiber reinforced composite material, switch the contacts 6, 8*a* and 8*b* via connecting mechanism sections 15, 15*a* and 15*b* received in the metal container, respectively. The connecting mechanism section 15, 15*a* and 15*b* constitute an operating force transmission mechanism comprising a bell crank mechanism or link mechanism. A reference numeral 19, in FIG. 1, is an insulated guide sleeve, in which the movable electrode 10 of the circuit breaker 5 is freely slidable.

Figure 2:
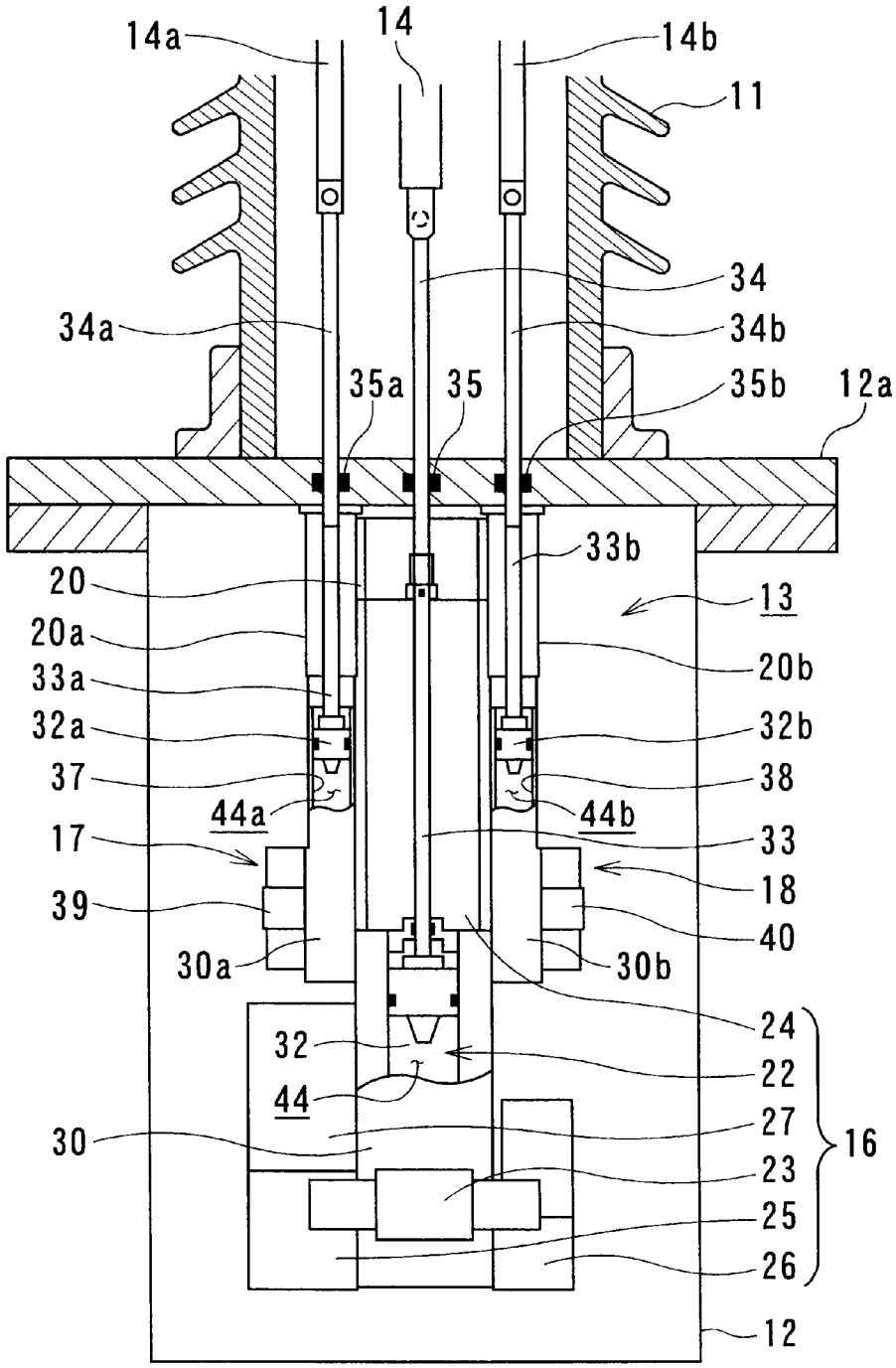
FIG. 2 is an enlarged front view showing the neighborhood of mechanical box in the first embodiment.
Figure 3:
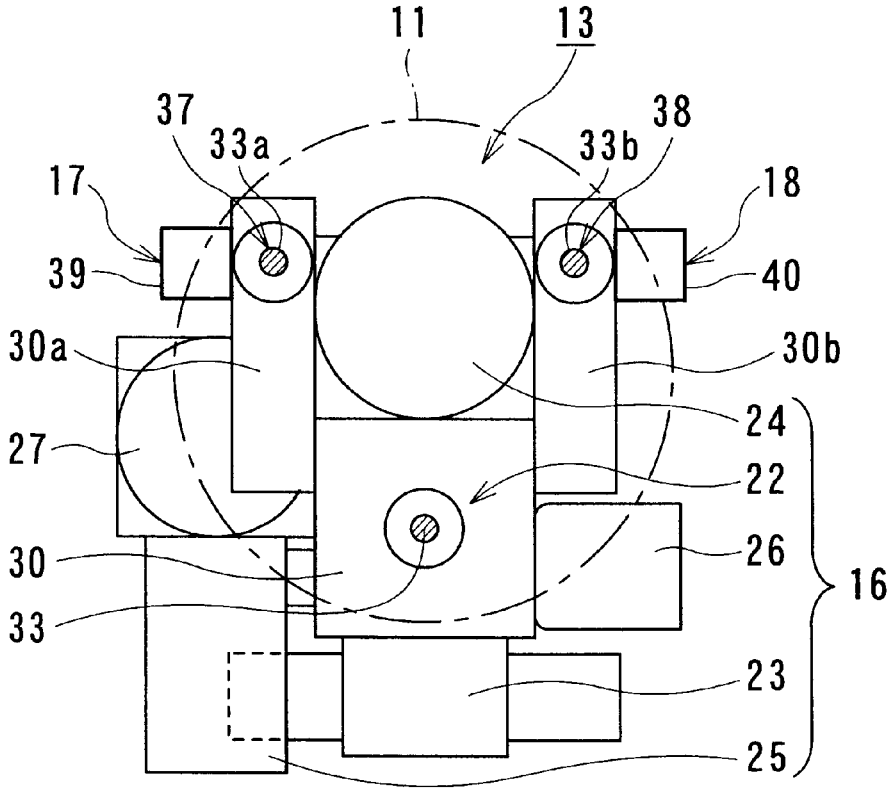
FIG. 3 is a top plan view schematically showing the inside of mechanical box when viewed from a support porcelain tube shown in FIG. 2.

The fluid pressure operating device 13 of the combined type fluid pressure driving apparatus is constructed as shown in FIG. 2 and FIG. 3. FIG. 2 is an enlarged front view showing the mechanical box 12 of the combined type fluid pressure driving apparatus, and FIG. 3 is a top plan view showing the inside of mechanical box 12 when viewed from a support porcelain tube 11 side.

As shown in FIG. 2 and FIG. 3, the fluid pressure operating device 13 is received in the mechanical box 12. Further, the fluid pressure operating device 13 includes a circuit-breaker fluid pressure operating section 16 for, which controls the switching contact 6 of the circuit breaker 5, and disconnecting-switch fluid pressure operating sections or devices 17 and 18, which control switching of contacts 8*a* and 8*b* of two disconnecting switches 7*a* and 7*b*. The fluid pressure operating device 13 is constructed in a manner that these fluid pressure operating sections 16 to 18 are combined and integrally assembled. The hydraulic operating device 13 is mounted or supported on a box cap 12*a* of the mechanical box 12 so as to make an assembly thereof easily.

The circuit-breaker fluid pressure operating section 16 is received in the mechanical box 12, and then, is fixed to a case cap 12*a* of the mechanical box 12 via an attachment frame 20. Further, the circuit-breaker fluid pressure operating section 16 includes a fluid pressure cylinder 22, a fluid pressure control valve 23, an accumulator 24, a pump 25, a hydraulic or fluid pressure monitor 26, and a low pressure tank 27. More specifically, the fluid pressure cylinder 22 drives the contact 6 of the circuit breaker 5, and the fluid pressure control valve 23 controls a working fluid for driving the fluid pressure cylinder 22, such as a hydraulic actuator. The accumulator 24 always stores a working fluid, such as a working mineral oil, which is a high-pressure working fluid to the fluid pressure cylinder 22, and the pump 25 generates a high-pressure working fluid. The fluid pressure monitor 26 monitors a pressure of high pressure working fluid, and the low pressure tank 27 stores a low-pressure fluid.

The fluid pressure cylinder 22 of the circuit-breaker fluid pressure operating section 16 is formed in a triangular block manifold 30. The outer surface of the manifold 30 is attached with the fluid pressure control valve 23, the hydraulic accumulator 24, the pump 25, the low pressure tank 27 and the fluid pressure monitor 26, which are removable.

Further, a fluid pressure piston 32 is slidably received in the fluid pressure cylinder 22, and a piston rod 33 is fixed as an operating rod to the fluid pressure piston 32. The piston rod 33 is connected with a driving rod 34. The driving rod 34 penetrates through a seal section 35 sealing an insulating gas, and then, is connected to the insulated operating rod 14.

On the other hand, the disconnecting-switch fluid pressure operating sections 17 and 18 are fixed to the box cap 12*a* of the mechanical box 12 via attachment frames 20*a* and 20*b*, respectively. Further, the disconnecting-switch fluid pressure operating sections 17 and 18 include fluid pressure cylinders 37 and 38, and fluid pressure control valves 39 and 40, respectively. More specifically, the fluid pressure cylinders 37 and 38 switch the contacts 8*a* and 8*b* of two disconnecting switches 7*a* and 7*b*, respectively. The fluid pressure control valves 39 and 40 controls a working fluid for operating the fluid pressure cylinders 37 and 38, respectively.

The disconnecting-switch fluid pressure operating sections 17 and 18 use the following elements included in the circuit-breaker fluid pressure operating section 16 in common. The elements are the accumulator 24 always storing a high-pressure working fluid to the fluid pressure cylinders 37 and 38, the pump 25 generating a high-pressure working fluid, the fluid pressure monitor 26 monitoring a pressure of high pressure working fluid, and the low pressure tank 27 storing a low-pressure fluid.

The fluid pressure control valves 39 and 40 are attached to the manifolds 30*a* and 30*b* of the corresponding fluid pressure cylinders 37 and 38, respectively, and are connected to the manifold 30 of the circuit-breaker fluid pressure operating section 16 side. Fluid pressure pistons 32*a* and 32*b* are slidably received in the fluid pressure cylinders 37 and 38, respectively. The fluid pressure pistons 32*a* and 32*b* are provided with piston rods 33*a* and 33*b* as an operating rod, respectively. These piston rods 33*a* and 33*b* are connected with driving rods 34*a* and 34*b*, respectively. The driving rods 34*a* and 34*b* penetrate through seal sections 35*a* and 35*b* sealing an insulating gas, and then, are connected to the insulated operating rods 14*a* and 14*b*, respectively.

Figure 4:
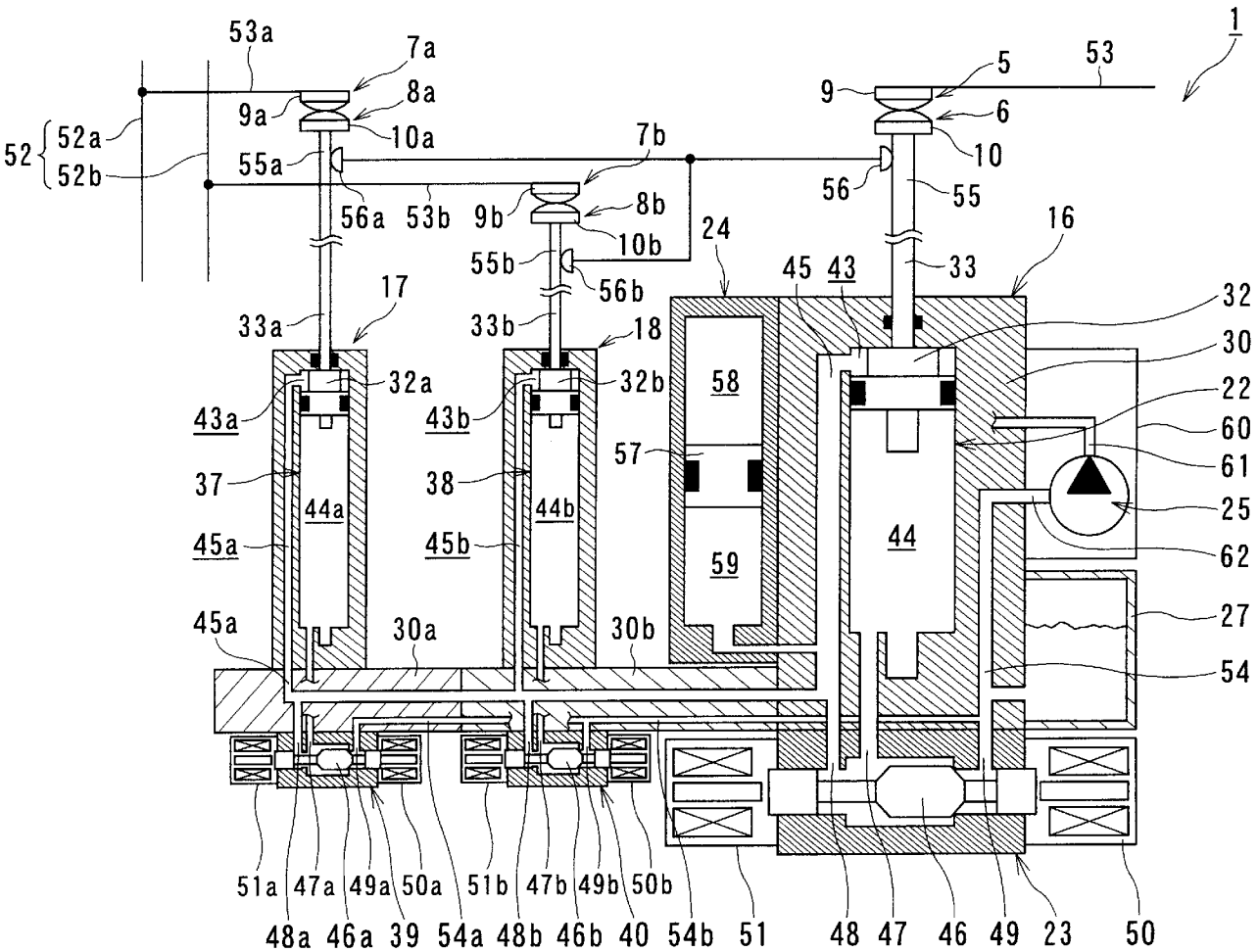
FIG. 4 is a view schematically showing a fluid pressure circuit of the combined type fluid pressure driving apparatus according to the first embodiment of the present invention.

FIG. 4 is a view schematically showing a configuration of fluid pressure circuit of the circuit-breaker fluid pressure operating section 16 and the disconnecting-switch fluid pressure operating sections 17 and 18 constituting the fluid pressure driving device 13.

First, the following is a description of the configuration of fluid pressure circuit of the circuit-breaker fluid pressure operating section 16. The fluid pressure cylinder 22 is formed with a first cylinder chamber 43, which forms a chamber for opening the contact 6, at a piston rod 33 of the fluid pressure piston 32, and is formed with a second cylinder chamber 44 at the side opposite to the piston rod 33. The first cylinder chamber 43 of the fluid pressure cylinder 22 is communicated with the accumulator 24 via a high-pressure fluid passage 45 formed in the manifold 30, and further, is communicated with the fluid pressure control valve 23 via the high-pressure fluid passage 45. The second cylinder chamber 44 of the fluid pressure cylinder 22 is communicated with the fluid pressure control valve 23.

The fluid pressure control valve 23 has a spool-valve type directional control valve body 46, for changing the fluid passages, while being formed with a control port 47, a fluid feed port 48 and a fluid discharge port 49. The directional control valve body 46 is operated by an open electromagnetic coil 50 and a close electromagnetic coil 51 so as to be freely slidable. Further, the directional control valve body 46 selectively switches the control port 47 into the fluid feed port 48 or the discharge port 49. The control port 47 feeds and discharges a high-pressure working fluid to and from the second cylinder chamber 44 of the fluid pressure cylinder 22. The fluid feed port 48 is always communicated with the accumulator 24 and the first cylinder chamber 43 of the fluid pressure cylinder 22 via the high-pressure fluid passage 45.

On the other hand, the fluid discharge port 49 is always connected to the low-pressure tank 55 via the low-pressure fluid passage 54 formed in the manifold 30. The open electromagnetic coil 50 and the close electromagnetic coil 51 supply an electromagnetic force for sliding the directional control valve body 46 so as to switch the fluid passage of the directional control valve 23.

The accumulator 24 is provided with an accumulator piston 57, which is freely slidable therein. One side of the accumulator piston 57, for example, a backside chamber 58 is filled with a high-pressure nitrogen gas or the like, and the other side thereof is formed with an accumulated fluid chamber 59 for storing a high-pressure working fluid, such as for example working mineral oil. Further, the accumulator 24 is connected directly to the manifold 30, and then, is integrally constructed. The storage chamber 59 is always communicated with the first cylinder chamber 43 of the fluid pressure cylinder 22 via the high-pressure fluid passage 45.

The pump 25 is attached to the manifold 30 via a receiving case 60, and is driven by a motor (not shown). An outlet port 61 and an inlet port 62 of the pump 25 are communicated with the high-pressure fluid passage 45 and the low-pressure fluid passage 54, respectively.

The low-pressure tank 27 is attached so as to cover a part of the side of manifold 30. An opening portion of the low-pressure tank 27 communicates with the low-pressure fluid passage 54 of the manifold 30.

Next, the following is a description of the configuration of fluid pressure circuit of the disconnecting-switch fluid pressure operating sections 17 and 18. The fluid pressure cylinders 37 and 38 and the fluid pressure control valves 39 and 40 have the substantially same configuration as the fluid pressure cylinder 22 and the fluid pressure control valve 23 of the circuit-breaker fluid pressure operating section 16. The fluid pressure cylinders 37 and 38 are provided at manifold blocks 30*a* and 30*b* extending from the manifold 30. In this case, receive fluid pressure piston 32*a* and 32*b* are individually received in the fluid pressure cylinders 37 and 38 so as to be freely slidable. Piston rods 33*a* and 33*b* of the fluid pressure pistons 32*a* and 32*b* are formed with first cylinder chambers 43*a* and 43*b,* respectively. The sides opposite to the piston rods 33*a* and 33*b* are individually formed with second cylinder chambers 44*a* and 44*b*.

The first cylinder chambers 43*a* and 43*b* of the fluid pressure cylinders 37 and 38 are communicated with the accumulator 24 and the fluid pressure control valves 39 and 40 via the high-pressure fluid passages 45*a* and 45*b* formed in the manifold blocks 30*a* and 30*b,* respectively. Further, the second cylinder chambers 44*a* and 44*b* of the fluid pressure cylinders 37 and 38 are communicated with the fluid pressure control valves 39 and 40, respectively.

The fluid pressure cylinders 37 and 38 are provided with control ports 47*a* and 47*b,* fluid feed ports 48*a* and 48*b,* and fluid discharge ports 49*a* and 49*b,* respectively. More specifically, the control ports 47*a,* 47*b* selectively feed and discharge a high-pressure working fluid to and from the second cylinder chambers 44*a* and 44*b* of the fluid pressure cylinders 37 and 38, respectively. The fluid feed ports 48*a* and 48*b* communicate with the accumulator 24 and the first cylinder chambers 43*a* and 43*b* of the fluid pressure cylinders 37 and 38 via high-pressure fluid passages 45*a* and 45*b,* respectively. The fluid discharge ports 49*a* and 49*b* are connected to the low-pressure tank 27 via the low-pressure fluid passages 30*a* and 30*b* formed in the manifold blocks 30*a* and 30*b,* respectively.

Further, the fluid pressure cylinders 37 and 38 are provided with control valves 39 and 40 for changing the fluid passages, respectively. The directional control valve bodies 46*a* and 46*b* of the control valves 39 and 40 selectively switch control ports 47*a* and 47*b* into fluid feed ports 48*a* and 48*b* or fluid discharge ports 49*a* and 49*b,* respectively. Further, the directional control valve bodies 46*a* and 46*b* are driven by an electromagnetic force from open electromagnetic coils 50*a* and 50*b,* and close electromagnetic coils 51*a* and 51*b,* respectively. In FIG. 4, a reference numeral 52 denotes double busbars of power transmission system, which comprise first busbar 52*a* and second busbar 52*b,* such as main bus line, and a reference numeral 53 denotes an electric transmission line or circuit line. The electric transmission line 53 is electrically connected to both of the busbars 52*a* and 53*a,* such as main bus line, through a first circuit line 53*a* and second circuit line 53*b*.

The movable electrode or movable switching element 10 of the circuit breaker 5 is fixed to a top end of a metal electrode rod 55, which is slidably supported on an electrode terminal 56. The electrode terminal 56 is electrically connected to two electrode terminals 56*a* and 56*b* of the disconnecting switches 7*a* and 7*b* via the metal housing 3. The electrode terminals 56*a* and 56*b* supporting slidably metal electrode rods 55*a* and 55*b,* are fixed to the metal container or housing 3 in a gastight fashion. The metal electrode rods 55*a* and 55*b* have the movable electrodes or movable switching contacts 10*a* and 10*b* on the top thereof. Therefore, the movable switching element 10, 10*a* and 10*b* are electrically connected to each other, and bottom ends of the electrode rods 55, 55*a* and 55*b* are mechanical connected to the connecting mechanical sections (devices) 15, 15*a* and 15*b,* respectively.

Subsequently, the following is a description of an operation of the fluid pressure operating device 13 of the combined type fluid pressure driving apparatus.

FIG. 4 shows a state that a current is applied to the contact 6 of the circuit breaker 5 of the insulating switch 1, and the contacts 8*a* and 8*b* of the disconnecting switches 7*a* and 7*b*. Namely, FIG. 4 shows a state that these contacts 6, 8*a* and 8*b* are switched by the circuit-breaker fluid pressure operating section 16 and the disconnecting-switch fluid pressure operating sections 17 and 18.

The accumulated fluid chamber 59 of the accumulator 24 of the fluid pressure operating section 16 is accumulated using compression of nitrogen gas pressing the accumulator piston 57. A high-pressure working fluid from the accumulator 24 always acts to the first cylinder chamber 43 of the circuit-breaker fluid pressure cylinder 22 via the high-pressure fluid passage 45. In this case, the high-pressure working fluid acts onto the surface of the fluid pressure piston 32 in the first cylinder chamber 43, and the area is set as S1. Further, the force acting on the fluid pressure piston 32 is set as F1. Likewise, the high-pressure working fluid acts onto the disconnecting-switch fluid pressure cylinders 37 and 38.

At that time, in the fluid pressure control valve 23, the fluid feed port 48 and the control port 47 communicate with each other by the directional control valve body 46; therefore, the high-pressure working fluid (fluid such as high-pressure working oil) acts to the second cylinder chamber 44 of the circuit-breaker fluid pressure cylinder 22. In this case, the high-pressure working fluid acts onto the surface of the fluid pressure piston 32 in the second cylinder chamber 44, and the area is set as S1. Further, the force acting on the fluid pressure piston 32 is set as F2.

In the fluid pressure operating device 13 of the combined type fluid pressure driving apparatus, the relation of acting area of the fluid pressure cylinder 22 to the fluid pressure piston 32 is $S1<S2$. Therefore, the force acting to the fluid pressure piston 32 is $F1<F2$. Namely, the fluid pressure piston 32 is pushed up from the second fluid pressure chamber 44, and then, is kept at a making position as shown in FIG. 4.

Likewise, in the fluid pressure control valves 39 and 40, the fluid feed ports 48*a,* 48*b* and the control port 47*a,* 47*b* communicate with each other by the directional control valve bodies 46*a* and 46*b;* therefore, the fluid pressure pistons 32*a* and 32*b* are kept at a making position as shown in FIG. 4.

As described above, in the fluid pressure operating device 13 of the combined type fluid pressure driving apparatus, all fluid pressure cylinders 22, 37 and 38 are in a making state. In the case where the circuit breaker 5 and the disconnecting switches 7*a* and 7*b* are opened from the above state, that is, from the making state as shown in FIG. 4, the following operation is carried out.

In the case of carrying out a breaking operation for opening the contact 6 of the circuit breaker 5, the circuit-breaker fluid pressure operating section 16 is operated. When a current is applied to the open electromagnetic coil 50 of the fluid pressure control valve 23, the electromagnetic coil 50 is excited so that the directional control valve body 46 is moved to the left-hand side in FIG. 4. Then, the directional control valve body 46 makes a fluid passage switching operation so that the control port 47 and the fluid discharge port 49 are communicated with each other. Therefore, the high-pressure working fluid of the second cylinder chamber 44 of the fluid pressure cylinder 22 is moved from the control port 47 to the fluid discharge port 49. For this reason, a fluid pressure of the second cylinder chamber 44 is reduced; as a result, the force acting onto the fluid pressure piston 62 becomes the relation of F1>F2. The acting force F1 of the high-pressure working fluid acting in the first cylinder chamber 43 drives the fluid pressure piston 32 so as to forcedly open the contact 6 of the circuit breaker 5 connected to the piston rod 33. During this breaking operation, a discharged fluid from the second cylinder chamber 44 of the fluid pressure cylinder 22 is once recovered into the low-pressure tank 27 via the low-pressure fluid passage 54.

On the other hand, in the case of closing the contact 6 of the circuit breaker 5, that is, carrying out a making or closing operation, in the circuit-breaker fluid pressure operating section 16, a current is applied to the close electromagnetic coil 51 of the fluid pressure control valve 23. When the electromagnetic coil 51 is excited, the control valve body is moved to the right-hand side in FIG. 4, and then, the directional control valve body 46 makes a reverse switching operation. By doing so, the fluid discharge port 49 is closed, and the fluid feed port 48 and the control port 47 are communicated with each other. As a result, the high-pressure working fluid is fed to the second cylinder chamber 44 of the fluid pressure cylinder 22, and the acting force of the fluid pressure piston 32 becomes the relation F1<F2. Therefore, the high-pressure working fluid of the second cylinder chamber 44 drives the fluid pressure piston 32 so that the piston 32 is pushed up, and thereby, the contact 6 of the circuit breaker 5 connected to the piston rod 33 is closed.

By the above breaking and making operations of the circuit breaker 5, the high-pressure working fluid of the circuit-breaker fluid pressure operating section 16 is consumed, and then, a fluid pressure of the fluid accumulated chamber 58 of the accumulator 24 is reduced. However, in this case, the discharged fluid recovered in the low-pressure tank 27 is fed back from the outlet port 61 to the fluid accumulated chamber 59 of the accumulator 24, and therefore, the internal fluid pressure of the fluid accumulated chamber 59 rises again.

Further, in the case of making an inspection for the electrical machinery and apparatus, the contact 6 of the circuit breaker 5 is opened, and thereafter, it is possible to open the first contact 8*a* and/or the second contact 8*b* of the disconnecting switches 7*a* and 7*b*. Thus, the switching operation of the first and second contacts 8*a* and 8*b* of the disconnecting switches 7*a* and 7*b* can be carried out in the same manner as the case of the circuit breaker 5, and further, can be performed independently from each other. More specifically, in the breaking state of the circuit-breaker fluid pressure operating section 16, in the case of breaking only disconnecting-switch fluid pressure operating section 17, a signal is given to the open electromagnetic coil 50*a* of the fluid pressure control valve 39. By doing so, the directional control valve body 46*a* is operated, and thereby, the fluid pressure of the second cylinder chamber 44*a* of the fluid pressure cylinder 37 is reduced. The high-pressure working fluid acts in the first cylinder chamber 43*a*. For this reason, the fluid pressure piston 32*a* is driven so as to open the first contact 8*a*. Conversely, the making or closing operation is carried out in the same manner as the circuit-breaker fluid pressure operating section 16.

Further, the switching or closing operation of the second contact 8*b* of the disconnecting switch 7*b* is carried out in the same manner as the disconnecting switch 7*a*.

In the insulating switch 1 to which the combined type fluid pressure driving apparatus is applied, the following effects can be obtained.

It is possible to switch the contacts 8*a* and 8*b* of the disconnecting switches 7*a* and 7*b* according the same fluid pressure driving method as the driving method for switching the contact 6 of the circuit breaker 5. Therefore, the fluid pressure driving apparatus can be integrally combined, and the fluid pressure operating sections 16 to 18 of the fluid pressure driving apparatus can be used in common, and can be miniaturized.

Further, the above fluid pressure driving method is employed, and thereby, high output is readily possible, and the fluid pressure cylinders 37 and 38 of the disconnecting-switch fluid pressure operating sections 17 and 18 and the fluid pressure control valves 39 and 40 can be made into a compact size; therefore, it is possible to secure preferable operation reliability. In particular, even in the case where there is a need of cutting off a loop current with respect to the disconnecting switches 7*a* and 7*b* in switching an electric transmission line 53*a* and 53*b*, it is possible to readily make high a switching speed of the contacts 8*a* and 8*b*, and to improve insulation recovery characteristic between the contacts 8*a* and 8*b*.

Further, the connecting mechanism sections 14, 14*a* and 14*b* are received in the metal container 3, and the insulated operating rods 15, 15*a* and 15*b* are received in the support porcelain tube 11; therefore, it is possible to make compact the porcelain tubes 2, 2*a* and 2*b* even if they are installed in the metal container 3. As a result, three receiving porcelain tubes 2, 2*a* and 2*b* can be attached to a single metal container 3. By doing so, the insulating and switch 1 having the circuit breaker 5 and two disconnecting switches 7*a* and 7*b* can be miniaturized. In addition, it is possible to make small the metal container 3 receiving the connecting mechanism sections 14, 14*a* and 14*b*, and miniaturization and compact size can be achieved; therefore, it is possible to contribute for making compact the insulating switch 1, and to greatly reduce the cost.

Further, in the fluid pressure operating device 13, the circuit-breaker fluid pressure operating section 16 and the disconnecting-switch fluid pressure operating sections 17 and 18 use the accumulator 24, the pump 25, the low-pressure tank 27 and the fluid pressure monitor 26 in common. Therefore, this serves to further integrally combine the fluid pressure driving apparatus, and is effective in a reduction of the number of components and in simplification. In addition, the member attached to the manifold 30 on the disconnecting-switch fluid pressure operating section 16 is removable; therefore, the disassembling work for inspection is simple, and maintenance and inspection can be improved.

[Second embodiment]

Figure 5:
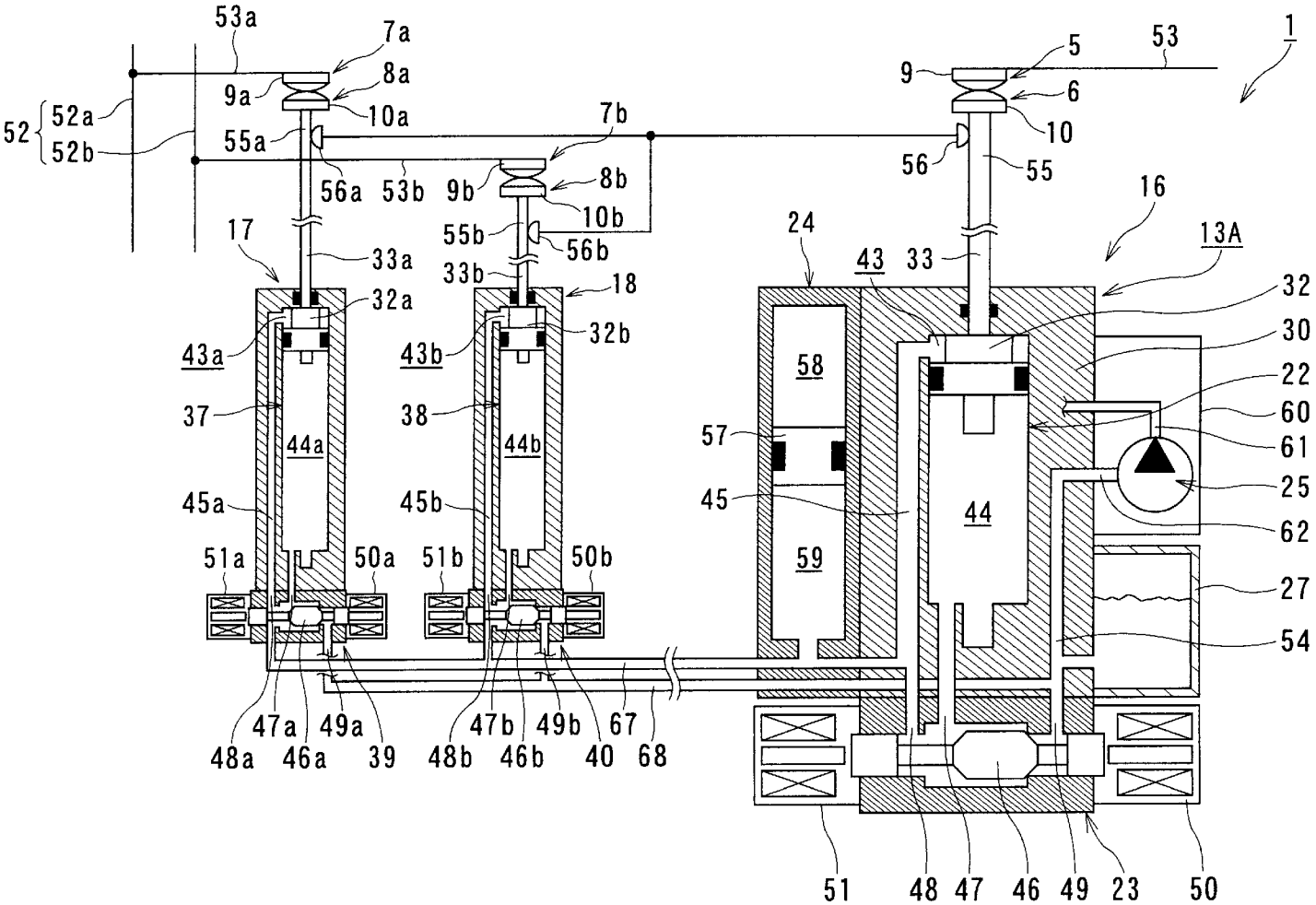
FIG. 5 is a view schematically showing a fluid pressure circuit of combined type fluid pressure driving apparatus according to a second embodiment of the present invention.

The second embodiment of the combined type fluid pressure driving apparatus of the present invention will be described below with reference to FIG. 5. In this case, like reference numerals are used to designate components having the same function as the above first embodiment, and the details are omitted.

The combined type fluid pressure driving apparatus shown in this second embodiment has the following features. More specifically, in a fluid pressure operating device 13A, the circuit-breaker fluid pressure operating section 16 and the disconnecting-switch fluid pressure operating sections 17 and 18 are connected to fluid pressure pipes 67 and 68, respectively. In other words, the fluid pressure cylinders 37 and 38 for driving the disconnecting switches 7*a* and 7*b* and the fluid pressure control valves 39 and 40 are arranged in a state of separating from the manifold 30 formed in the fluid pressure cylinder 22 for driving the circuit breaker.

In this case, the first cylinder chambers 43*a* and 43*b* of the fluid pressure cylinders 37 and 38 are communicated with the accumulator 24 via the high-pressure pipe 67 together with the fluid feed ports 48*a* and 48*b* of the fluid pressure control valves 39 and 40, respectively. Simultaneously, the fluid discharge ports 49*a* and 49*b* of the fluid pressure control valves 39 and 40 are connected to the low-pressure tank 27 via the low-pressure pipe 68, respectively. The fluid pressure driving apparatus constructed as described above has the same operation and function as the first embodiment, and has no different from there; and therefore, the details are omitted.

In the combined type fluid pressure driving apparatus shown in this second embodiment, the fluid pressure operating sections 16 to 18 of the fluid pressure operating device 13 can be freely arranged. In addition, in the same manner as the above first embodiment, these fluid pressure operating sections 16 to 18 can use the fluid pressure accumulator 24, the pump 25 and the low-pressure tank 27 in common. Therefore, it is possible to readily achieve a design for saving a space, miniaturization and simplification of the fluid pressure driving apparatus. In particular, in accordance with the layout of plural current-applied contacts of the transmission line 53 constituting the gas insulated switchgear, a part or all of the disconnecting-switch fluid pressure operating sections 17 and 18 is arranged at a position far from the circuit-breaker fluid pressure operating section 16. In this case, the fluid pressure pipes 67 and 68 is formed of a flexible pipe, for example, a flexible hose, and then, the flexible pipes 67 and 68 are merely connected, and thereby, it is possible to obtain the very effective layout of the fluid pressure driving apparatus.

[Third embodiment]

The third embodiment of the combined type fluid pressure driving apparatus of the present invention will be described below with reference to FIG. 6.

The combined type fluid pressure driving apparatus shown in this third embodiment has an improvement of position holding function of the first contact 8*a* of the disconnecting switch 7*a* shown in FIG. 1. In the above first and second embodiments, there is a possibility of the switching state of the disconnecting switch contact 8*a* is varied by the following influence. More specifically, the fluid pressure of the high-pressure working fluid drops down for inspection, and the contact 8*a* receives the weight of the fluid pressure piston 32*a* and gas pressure when the fluid pressure loss is generated by large-amount fluid leakage. In view of the above circumstances, for safety, the position holding function of the first contact 8*a* of the disconnecting switch 7*a* is improved so that the switching state of the disconnecting switch contact 8*a* is not varied.

Figure 6:
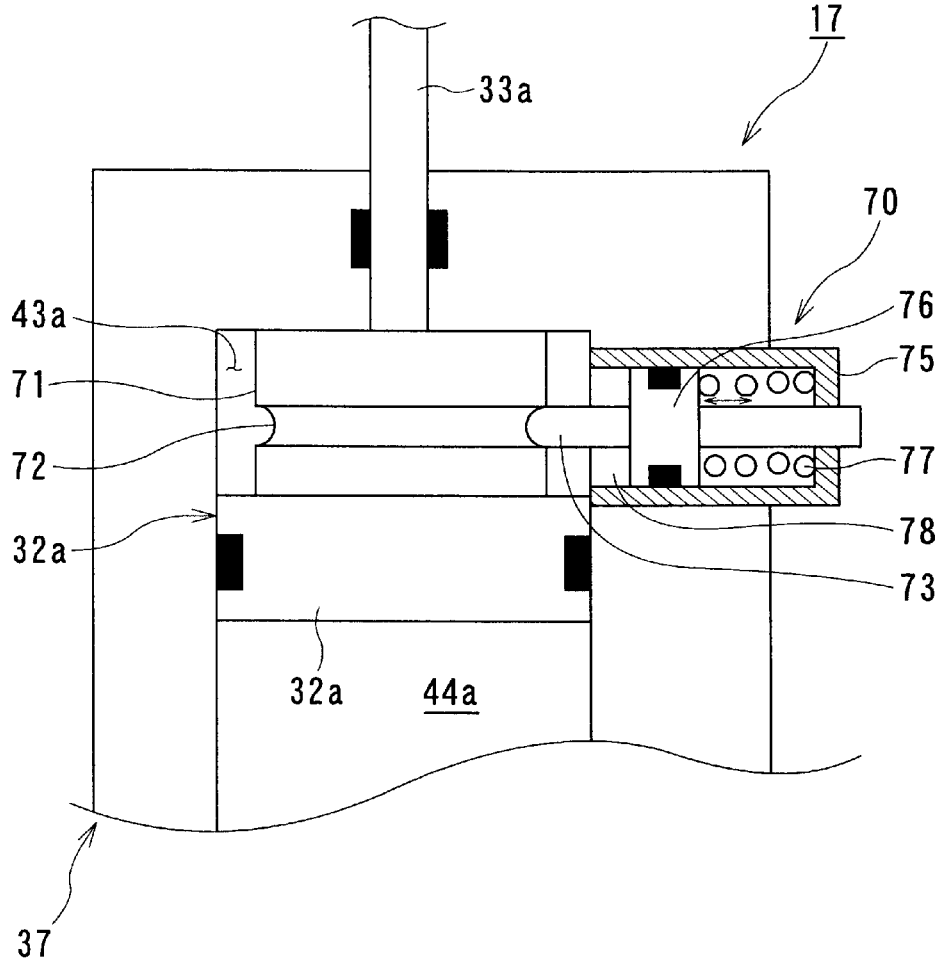
FIG. 6 is a view showing a configuration of principal parts of combined type fluid pressure driving apparatus according to a third embodiment of the present invention.

A combined type fluid pressure driving apparatus shown in FIG. 6 includes a piston holding mechanism 70 for holding a making state of the fluid pressure piston 32*a*. In this case, the configuration other than the piston holding mechanism 70 is the same as the first and second embodiments; therefore, like reference numerals are given, and the details are omitted.

In FIG. 6, the fluid pressure piston 32*a* sliding in the fluid pressure cylinder 37 is formed with a circumferential groove 72 at a small-diameter portion of the first cylinder chamber 43*a,* and an operating rod for holding a making position, that is, a lock pin 73 is fitted into the circumferential groove 72. The lock pin 73 is provided in a lock piston 76, which is slidably supported to a holding cylinder 75 of the piston holding mechanism 70. The lock piston 76 is urged by an elastic element provide at its backside, for example, a spring 77; on the other hand, the high-pressure working fluid from the accumulator 24 (see FIG. 4) is supplied to a cylinder chamber 78 opposite to the lock piston 76.

In a normal operation, the lock piston 76 is pressed into the cylinder chamber by the high-pressure working fluid against a spring force of the spring 77, and then, the lock pin 73 is held at a retreat position; therefore, the lock pin 73 has no contact with the circumferential groove 72 of the fluid pressure piston 32*a*. However, when the fluid pressure of high-pressure working fluid is lost, the lock piston 76 is projected by the spring force the spring 77, and then, the distal end portion of the lock pin 73 is fitted into the circumferential groove 72 of the fluid pressure piston 32*a,* and thereafter, is abutted against there. By doing so, the fluid pressure piston 32*a* is held at the making position. Further, the contact 8*a* (see FIG. 4) interlocking with the fluid pressure piston 32*a* is kept at a closed state.

On the other hand, in the breaking position (open position) of the fluid pressure piston 32*a,* a piston holding mechanism (not shown) of the fluid pressure piston 32*a* is provided in the same manner as above, and thereby, it is possible to hold the fluid pressure piston 32*a* at the open position.

In FIG. 6, the disconnecting switch 7*a* has been described as an example. The same piston holding mechanism is applicable to the fluid pressure pistons 32*b* and 32 of the disconnecting switch 7*b* and the circuit breaker 5.

According to this third embodiment, even if the fluid pressure of the combined type fluid pressure driving apparatus is lost, it is possible to securely hold the switching state of the contact 8*a* of the disconnecting switch 7*a,* and to improve reliability for safety of the fluid pressure driving apparatus.

[Fourth embodiment]

Figure 7:
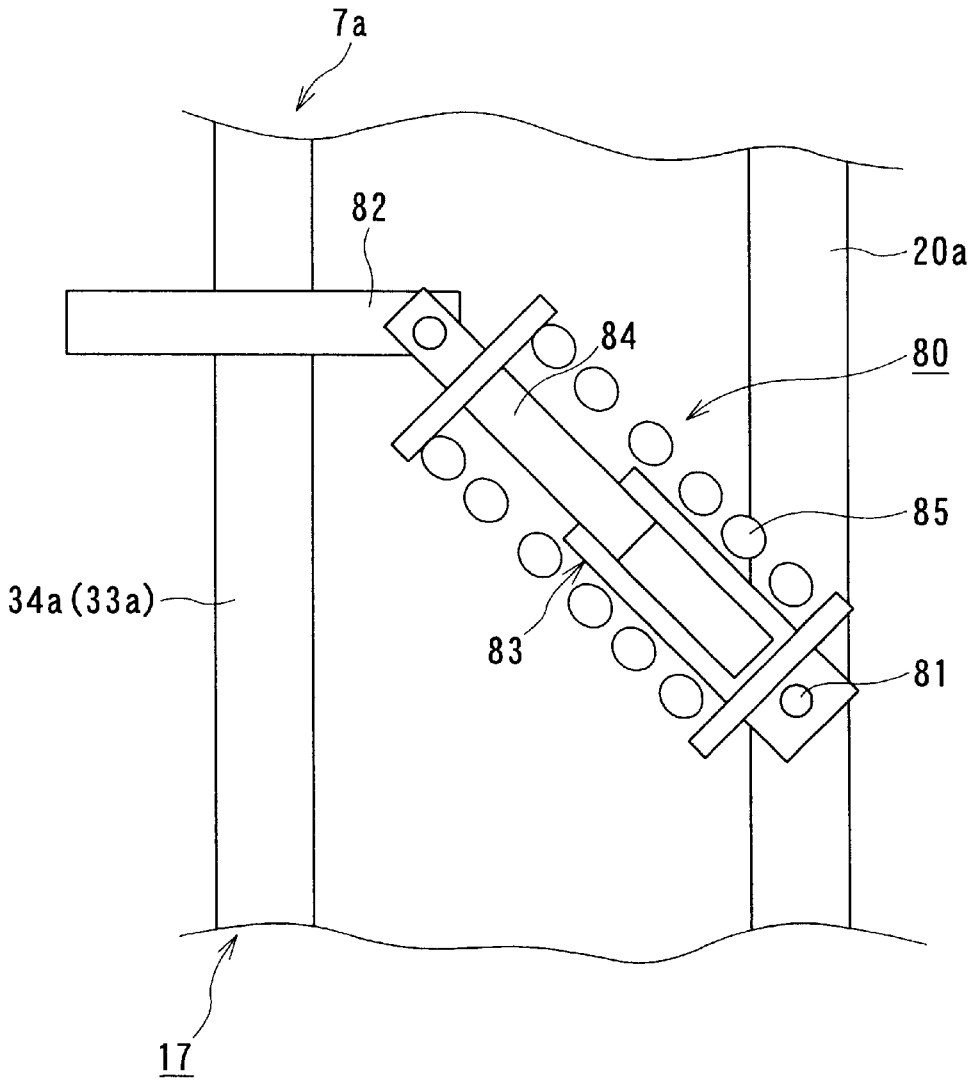
FIG. 7 is a view partially showing a configuration of principal parts of combined type fluid pressure driving apparatus according to a fourth embodiment of the present invention.

FIG. 7 is a view partially showing a configuration of principal parts of combined type fluid pressure driving apparatus according to a fourth embodiment of the present invention.

In this fourth embodiment, improvement is made in the position holding function of the contact 8*a* of the disconnecting switch 7*a* like the above third embodiment.

A combined type fluid pressure driving apparatus shown in FIG. 7 is provided with a toggle joint mechanism 80, which interlocks with the piston rod 33*a* or the driving rod 34*a* of the fluid pressure piston 32*a*. In this case, the configuration other than the toggle device 80 is the same as the first and second embodiments; therefore, like reference numerals are given, and the details are omitted.

The toggle device 80 is provided with a support portion 81, which is fixed on the attachment frame 20*a* supporting the fluid pressure cylinder 37 (see FIG. 4). The toggle device

80 is interposed between the support portion 81 and a flange 82 integrally provided on the driving rod 34*a*. Further, the toggle joint mechanism 80 includes a telescopic mechanism or an expansible rod mechanism 83, which is expansibly held, and an elastic element for urging an operating rod 84 of the expansible rod mechanism 83, for example, a spring 85.

In FIG. 7, the driving rod 34*a* of the disconnecting switch 7*a* has been described as an example. The same toggle mechanism is applicable to the fluid pressure pistons 34*b* of the disconnecting switch 7*b* and the driving rod 34 of the circuit breaker 5.

According to this fourth embodiment, it is possible to securely hold the making position or the breaking position of the fluid pressure piston 32*a* by the spring force (spring load) of the spring 85 regardless of the fluid pressure of the high-pressure working fluid. Further, it is possible to visibly confirm the switching state of the contact 8*a* from the outside, and thus, the inspection can be readily carried out.

[Fifth embodiment]

The fifth embodiment of combined type fluid pressure driving apparatus according to of the present invention will be described below with reference to FIG. 8.

In this fifth embodiment, improvement is made in the position holding function of the contact 8*a* of the disconnecting switch 7*a* of the combined type fluid pressure driving apparatus, like the above third and fourth embodiments.

Figure 8:
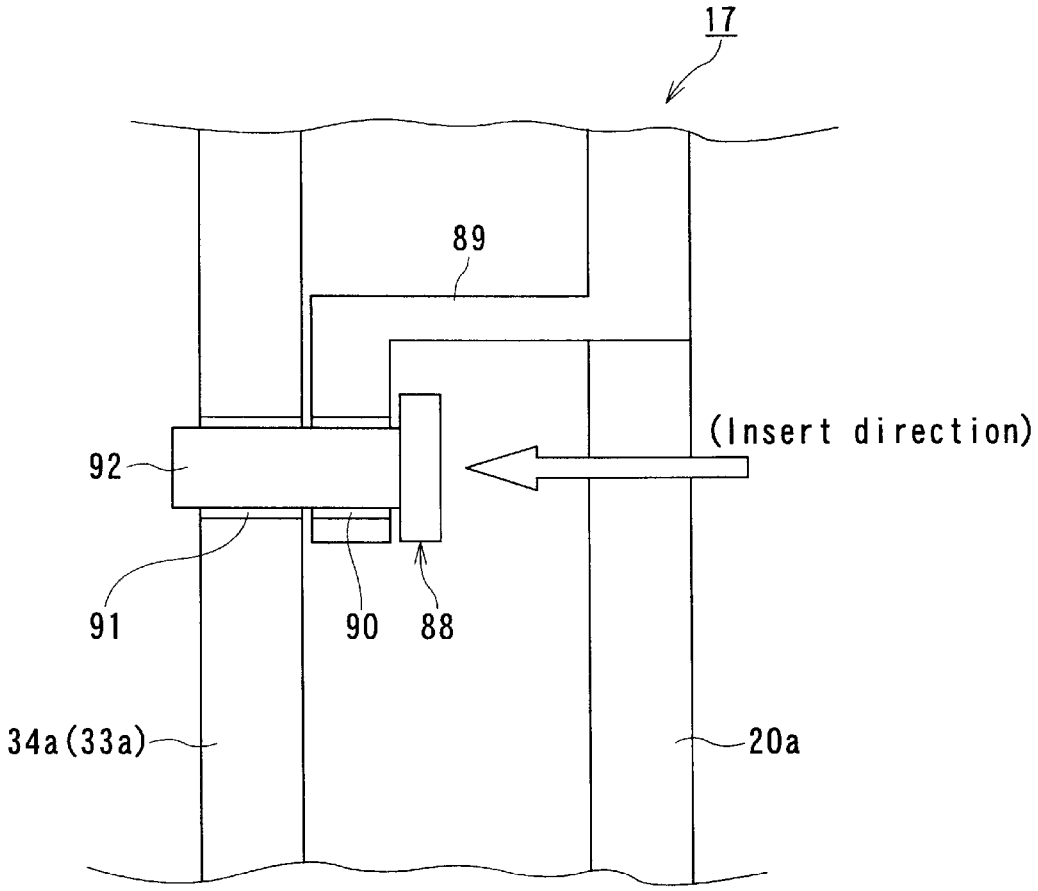
FIG. 8 is a view partially showing a configuration of principal parts of combined type fluid pressure driving apparatus according to a fifth embodiment of the present invention.

The combined type fluid pressure driving apparatus shown in FIG. 8 is provided with a rod lock mechanism 88, which locks the driving rod 34*a* or the piston rod 33*a* in the making or breaking state of the disconnecting switch 7*a*. In this case, the configuration other than the rod lock mechanism 88 is the same as the first and second embodiments; therefore, like reference numerals are given, and the details are omitted.

As shown in FIG. 8, the rod lock mechanism 88 is constructed in the following manner. More specifically, a bracket 89 extending from the attachment frame 20*a* faces the driving rod 34*a*, and the bracket 89 and the driving rod 34*a* are individually formed with through holes 90 and 91. In this case, these through holes 90 and 91 are formed so that they are aligned with each other in the making position or the breaking position of the fluid pressure piston 32*a* (see FIG. 4). When these through holes 90 and 91 are overlapped and aligned with each other, a lock pin 92 is inserted into these through holes 90 and 91, so as to lock the driving rod 34*a*, and thereby, the fluid pressure piston 32*a* can be held at the making or breaking position.

In FIG. 8, the driving rod 34*a* of disconnecting switch 7*a* has been described as an example. The same rod lock mechanism is applicable to the fluid pressure pistons 34*b* of the disconnecting switch 7*b* and the driving rod 34 of the circuit breaker 5.

According to this fifth embodiment, the rod lock mechanism 88 is used, that is, the lock pin 92 is inserted into the aligned through holes 90 and 91, and thereby, it is possible to securely hold the position of the fluid pressure piston 32*a*, and to readily hold the position of the fluid pressure piston 32*a* by manual. Further, inspection can be confirmed readily and visibly; therefore, it is possible to further improve safety and reliability.

[Sixth embodiment]

Figure 9:
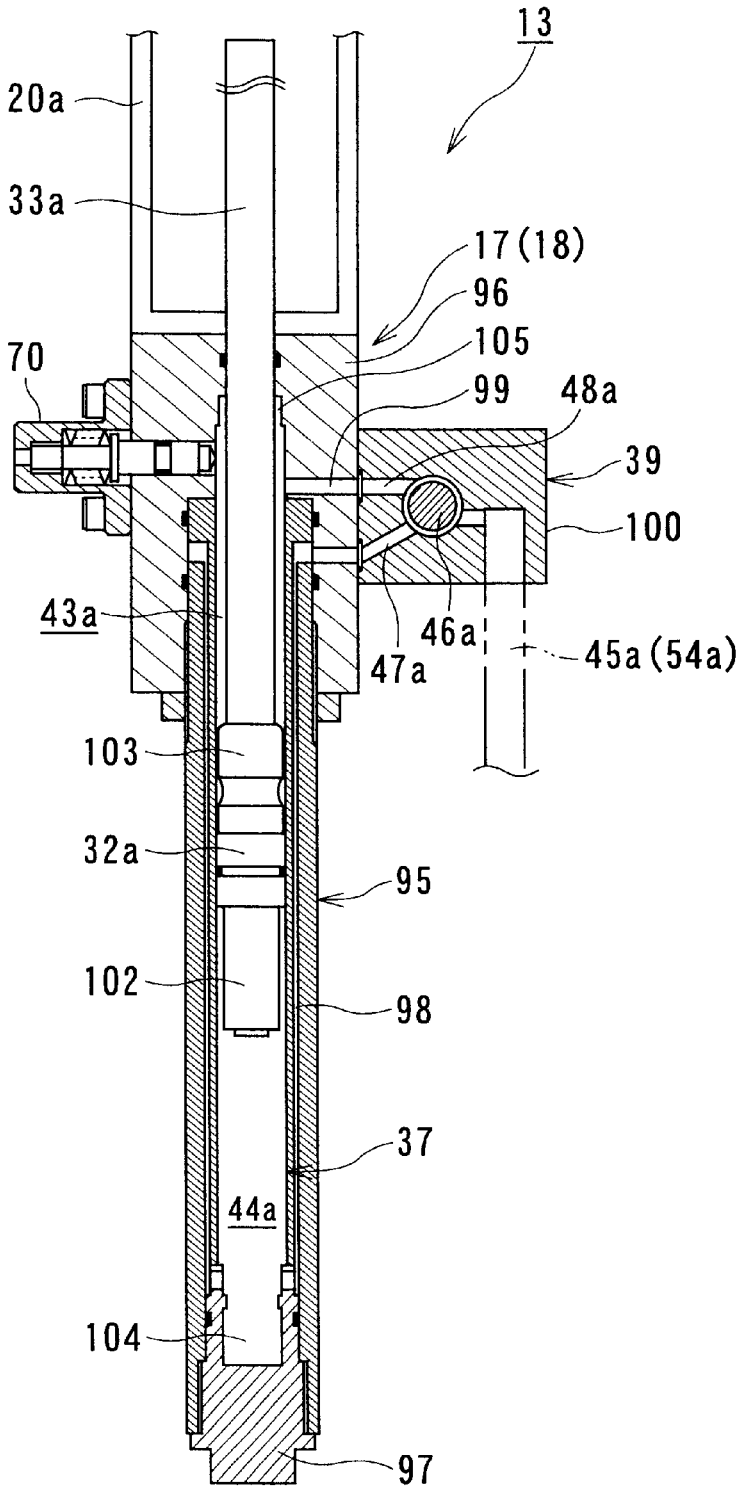
FIG. 9 is a front sectional view showing a configuration of combined type fluid pressure driving apparatus according to a sixth embodiment of the present invention.
Figure 10:
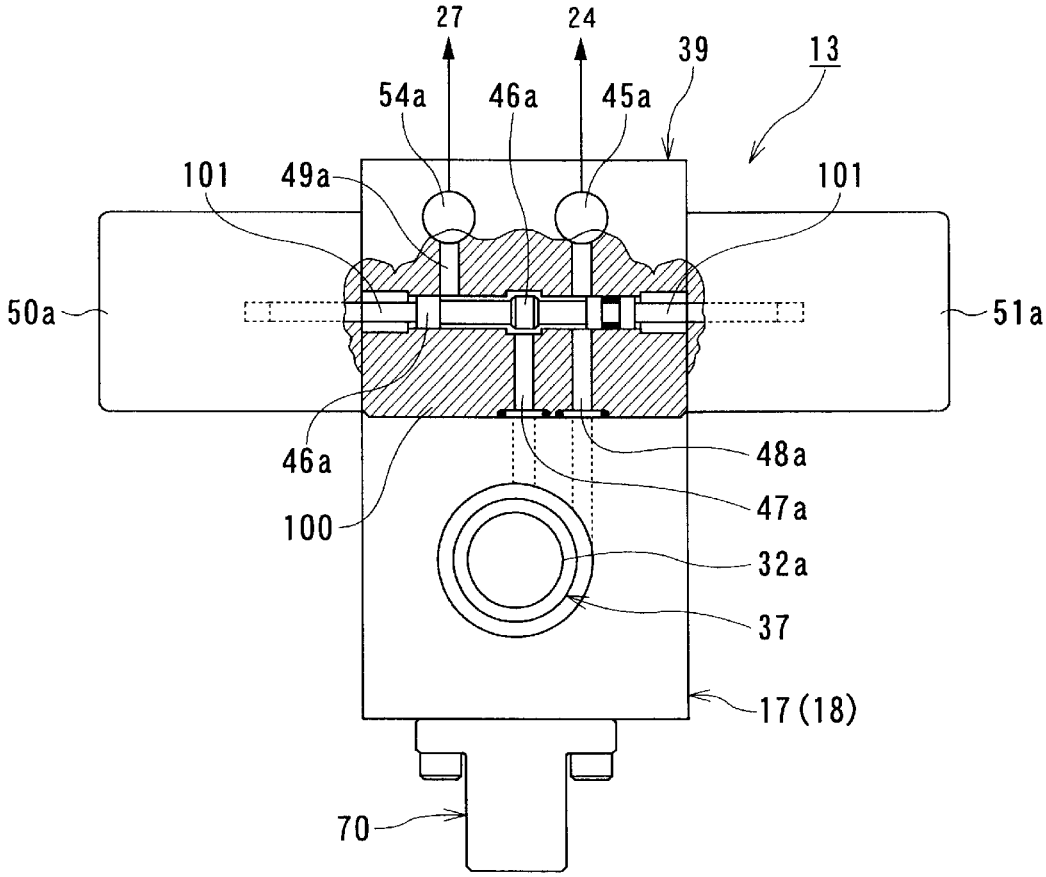
FIG. 10 is a side sectional view showing a configuration of combined type fluid pressure driving apparatus according to a sixth embodiment of the present invention.

FIG. 9 and FIG. 10 show a combined type fluid pressure driving apparatus according to a sixth embodiment of the present invention.

This sixth embodiment detailedly shows a configuration of the disconnecting-switch fluid pressure operating section 17 (18). FIG. 9 is a front sectional view showing a configuration of the disconnecting-switch fluid pressure operating section 17, and FIG. 10 is a side sectional view thereof. The other disconnecting-switch fluid pressure operating section is applied in the same manner as above. In this case, like reference numerals are used to designate components having the same function as the first and second embodiments, and the details are omitted.

In the disconnecting-switch fluid pressure operating section 17 shown in FIG. 9, The fluid pressure cylinder 37 slidably receiving the fluid pressure piston 32*a* and one end side of concentrically outer cylinder 95 coaxially arranged on the outer peripheral side of the fluid pressure cylinder 37 are inserted into a block-like cylinder head 96, and then, are fixed thereto. The cylinder head 96 supports slidably the piston rod 33*a* extending from the fluid pressure piston 32*a*, and is fixed to the frame 20*a* of the mechanical box 12 as shown in FIG. 2.

Further, the fluid pressure control valve 39 is provided above the cylinder head 96, and the other end of the outer cylinder 95 is attached with a plug 97 for sealing a working fluid. A substantially concentric cylinder structure is formed by the fluid pressure cylinder 37 and the outer cylinder 95, and further, a gap between the above cylinders, that is, an annular space is used as a control fluid passage 98, which communicates the fluid pressure control valve 39 with the second cylinder chamber 44*a* of the fluid pressure cylinder 37. The first cylinder chamber 43*a* of the fluid pressure cylinder 37 communicates with the fluid pressure control valve 39 via a fluid passage 99 formed in the cylinder head 96.

The fluid pressure control valve 39 includes a valve block 100 as shown in FIG. 10. The valve block 100 includes a control port 47*a*, a fluid feed port 48*a* and a fluid discharge port 49.

The following is a description of each function of the ports included in the fluid pressure control valve 39.

More specifically, the control port 47*a* selectively feeds or discharges a high-pressure working fluid to and from the second cylinder chamber 44*a* of the fluid pressure cylinder 37 connected to the control fluid passage 98. The fluid feed port 48*a* communicates with the accumulator 24 and the first cylinder chamber 43*a* of the fluid pressure cylinder 37 via the high-pressure fluid passage 45*a*. The fluid discharge port 49*a* is connected to the low-pressure tank 27 via the low-pressure fluid passage 54*a*.

Further, the valve block 100 includes a directional control valve body 46*a* of the fluid pressure control valve 39 for selectively switching the control port 47*a* into the fluid feed port 48*a* or the fluid discharge port 49*a*. The directional control valve body 46*a* carries out the port switching operation in the following manner; more specifically, a push rod 101 is driven by an electromagnetic force of the open electromagnetic coil 50*a* and the close electromagnetic coil 51*a* arranged on both sides of the valve block 100.

On the other hand, the fluid pressure control valve 39 is included in the cylinder head 96 so that the operating axis of the directional control valve body 46*a* and the operating axis fluid pressure piston 32*a* are perpendicular to each other.

The cylinder head 96 is provided with a piston holding mechanism 70 for holding a making state of the fluid pressure piston 32*a*, as shown in FIG. 6 described in the above third embodiment.

Moreover, the fluid pressure piston 32*a* is formed with a breaking damper piston 102 and a making damper piston 103 at its both sides. In the termination of open operation, the breaking damper piston 102 is fitted into the plug 97, and thereby, an open damper chamber 104 is formed. When the breaking damper piston 102 is inserted into the open damper chamber 104, the internal pressure of the damper chamber 104 increases, and thereby, the fluid pressure piston 32*a* is damped, and tend, is stopped. Likewise, in the termination of close operation, the making damper piston 103 is fitted into a part of the cylinder head 96, and thereby, a close damper chamber 105 is formed so that the fluid pressure piston 32*a* is smoothly stopped.

The disconnecting-switch fluid pressure operating section 17 (18) constructed as described above has the same operation and function as the above embodiments; therefore, the explanation is omitted.

According to this sixth embodiment, the following effects can be obtained.

In the disconnecting-switch fluid pressure operating section 17, the fluid pressure control valve 39 is included in the cylinder head 96 at the upper end portion of the operating section so that the operating axis of the directional control valve 46*a* and the operating axis fluid pressure piston 32*a* are perpendicular to each other. Therefore, there is no need of attaching structures other than the plug 97 for sealing a working fluid to the lower end portion of the disconnecting-switch fluid pressure operating section 17; as a result, this serves to realize a simple structure.

Further, the fluid pressure control valve 39 having a relatively heavy weight is arranged on the position near to the attachment frame 20*a,* which is an upper fixed point. Therefore, even if an external force such as vibration by the operation of the fluid pressure control valve 39 and vibration by the operation of the circuit-breaker fluid pressure operating section 16 having a relatively large driving force acts, no excessive vibration is generated in the fluid pressure cylinder 37. As a result, it is possible to provide a structure excellent in vibration proofing and strength. In particular, the lower end portion of the disconnecting-switch fluid pressure operating section 17 is light, so that it can be readily attached in the horizontal direction. Therefore, there is no limitation in attachment direction, and a degree of freedom of layout is improved.

Further, the directional control valve 46*a* of the fluid pressure control valve 39 and the fluid pressure piston 32*a* are perpendicular to each other in its operating direction. Therefore, even if an external force such as vibration by the operation of the fluid pressure piston 32*a* and vibration by the operation of the circuit-breaker fluid pressure operating section 16 having a relatively large driving force acts onto the operating axis of the fluid pressure piston 32*a,* an erroneous operation of the directional control valve 46*a* can be prevented. As a result, it is possible to realize a structure excellent in reliability.

On the other hand, in the making and breaking operations of the fluid pressure piston 32*a* of the disconnecting-switch fluid pressure operating section 17, the fluid passage is required for feeding and discharging a high-pressure working fluid to the second cylinder chamber 44*a* of the fluid pressure cylinder 37 via the fluid pressure control valve 39. In this sixth embodiment, a double cylindrical structure is formed by the fluid pressure cylinder 37 and the outer cylinder 95 coaxially provided so as to cover the cylinder 37, and then, a gap between two cylinder is used as the control fluid passage 98. Therefore, the control fluid passage 98 is arranged concentrically with the fluid pressure cylinder 37; as a result, this is advantageous to simplify the structure and to save a space as compared with the case where the control fluid passage is arranged separately.

[Seventh embodiment]

FIG. 11 shows a combined type fluid pressure driving apparatus according to a seventh embodiment of the present invention.

This seventh embodiment relates to a detailed structure of the disconnecting-switch fluid pressure operating section 17 (18), like the sixth embodiment.

Figure 11A:
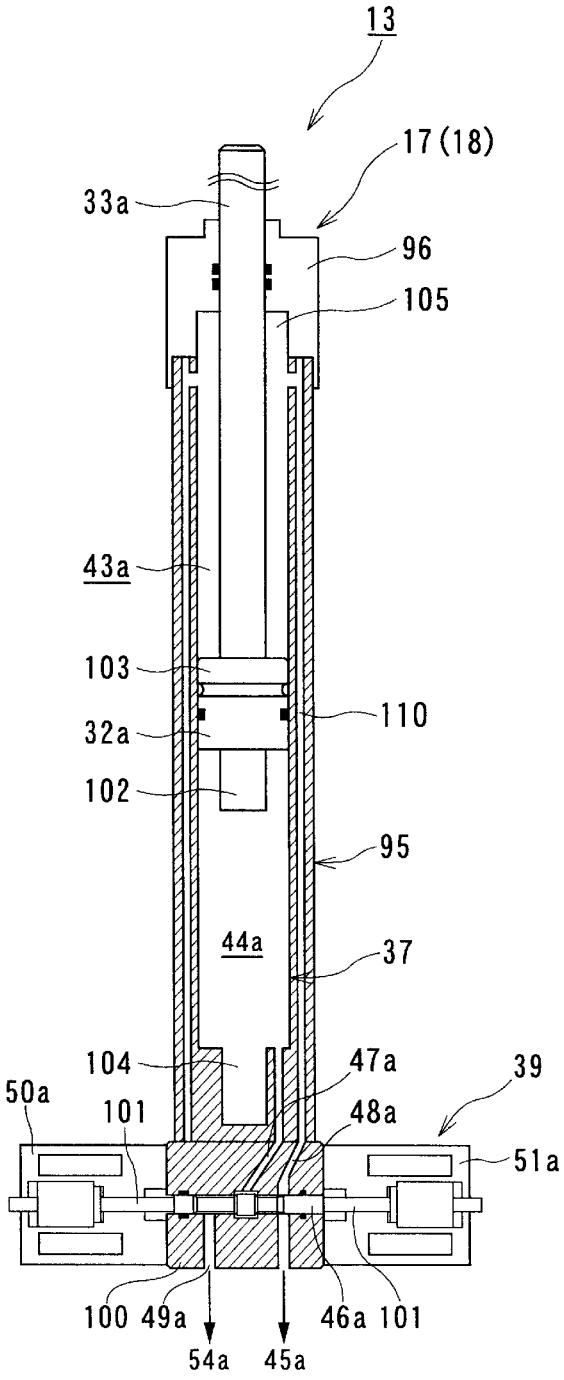
FIG. 11A and FIG. 11B are individually a front sectional view and a side view showing a combined type fluid pressure driving apparatus according to a seventh embodiment of the present invention.
Figure 11B:
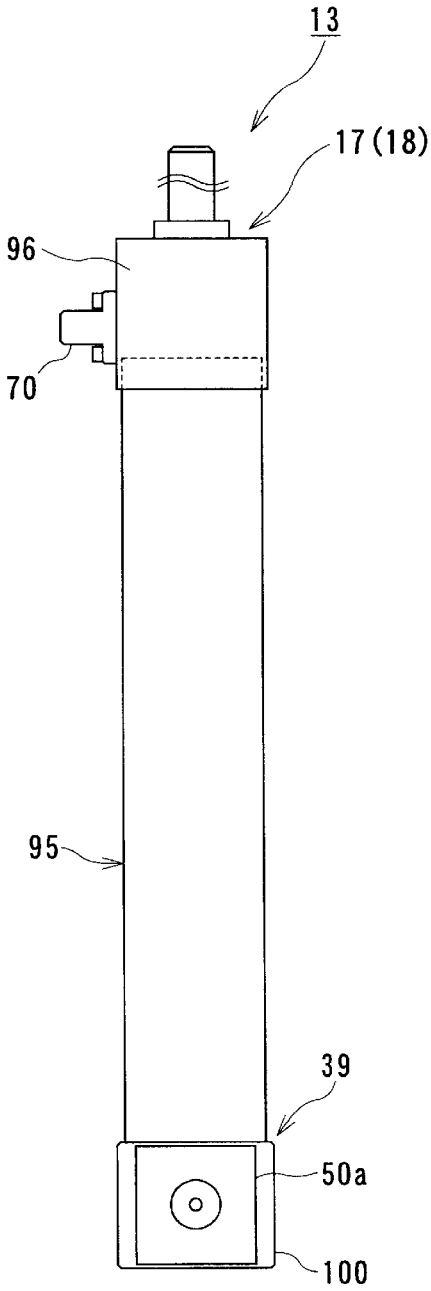

FIG. 11(A) and FIG. 11B are individually a front sectional view and a side view showing the disconnecting-switch fluid pressure operating section 17, and in this case, like reference numerals are used to designate components having the same function as the first and second embodiments, and the details are omitted.

In the disconnecting-switch fluid pressure operating section 17 shown in FIG. 11, the fluid pressure piston 32*a* is slidably received in the fluid pressure cylinder 37, and the outer cylinder 95 is concentrically arranged so as to cover the outer peripheral side of the fluid pressure cylinder 37. One end of the fluid pressure cylinder 37 and the outer cylinder 95 is inserted and fixed to the block-like cylinder head 96. The cylinder head 96 is fixed to the attachment frame 20*a* of the mechanical box 12 as shown in FIG. 2. The other end of the fluid pressure cylinder 37 and the outer cylinder 95 is provided with the fluid pressure control valve 39, and the valve block 100 is attached as a member for sealing a working fluid.

A double cylindrical structure is formed by the fluid pressure cylinder 37 and the outer cylinder 95, and a gap between two cylinders is used as a high-pressure fluid passage 110 communicating with the fluid pressure control valve 39 and the first cylinder chamber 43*a* of the fluid pressure cylinder 37. The cylinder head 96 is provided with the piston holding mechanism 70 for holding a making sate of the fluid pressure piston 32*a,* like the sixth embodiment.

The valve block 100 of the fluid pressure control valve 39 includes the fluid feed port 48*a,* the fluid discharge port 49*a* and the control port 47*a,* like the above sixth embodiment. More specifically, the fluid discharge port 49*a* is connected to the high-pressure fluid passage 110 formed between the double cylindrical gap, and the control port 47*a* selectively feeds or discharges a high-pressure working fluid to and from the second cylinder chamber 44*a* of the fluid pressure cylinder 37. Further, the valve block includes the directional control valve body 46*a* of the fluid pressure control valve 39 for selectively switching the control port 47*a* into the fluid feed port 48*a* or the fluid discharge port 49*a*. The directional control valve body 46*a* is driven via a push rod 101 by an electromagnetic force of the open electromagnetic coil 50*a* and the close electromagnetic coil 51*a* arranged on both sides of the valve block 100.

The fluid pressure control valve 39 is attached so that the operating axis of the directional control valve body 46*a* and the operating axis of the fluid pressure piston 32*a* are perpendicular to each other. The fluid pressure driving apparatus constructed as described above has the same operation and function as the above embodiments; therefore, the explanation is omitted.

According to this sixth embodiment, the following effects can be obtained.

In the disconnecting-switch fluid pressure operating section 17, the fluid pressure control valve 39 is attached to at the lower end portion of the operating section so that the operating axis of the directional control valve 46*a* and the operating axis fluid pressure piston 32*a* are perpendicular to each other. There is a need of attaching a member for sealing a working fluid to the lower end portion of the disconnecting-switch fluid pressure operating section 17. However, the valve block 100 of the fluid pressure control valve 39 is used in common as the above member, and thereby, the number of components is reduced, and the structure can be simplified. In addition, the valve block 100 is arranged on the cylindrical cross section of the outer cylinder 95; therefore, a compact design can be achieved without extending the member to a radius direction.

Further, in the case of discharging a high-pressure working fluid from the second cylinder chamber 44*a* of the fluid pressure cylinder 37 via the fluid pressure control valve 39, the fluid path is short; therefore, pressure loss is small, and the open operation is carried out at a high speed.

Further, the directional control valve body 46*a* of the fluid pressure control valve 39 and the fluid pressure piston 32*a* are perpendicular to each other in the operating direction. Therefore, even if an external force such as vibration by the operation of the fluid pressure piston 32*a* and vibration by the operation of the circuit-breaker fluid pressure operating section 16 having a relatively large driving or operating force acts onto the operating axis of the fluid pressure piston 32*a,* an erroneous operation of the directional control valve body 46*a* can be prevented. As a result, it is possible realize a structure excellent in reliability.

Further, the high-pressure fluid passage 110 connects the first cylinder chamber 43*a* of the fluid pressure cylinder 37 positioned on the upper end portion of the disconnecting-switch fluid pressure operating section 17 with the fluid feed port 48*a* of the fluid pressure control valve 39 provided on the lower end portion thereof. The high-pressure fluid passage 110 is formed by the fluid pressure cylinder 37 and the outer cylinder 95 concentrically provided so as to cover the outer peripheral surface of the cylinder 37, and then, the gap between the double cylindrical structure is used as an annular high-pressure fluid passage 110. In this case, the high-pressure fluid passage 110 is arranged coaxially with the fluid pressure cylinder 37; therefore, it is advantageous to simplify the structure, and to save a space as compared with the case where the fluid passage is arrange separately.

[Eighth embodiment]

Figure 12:
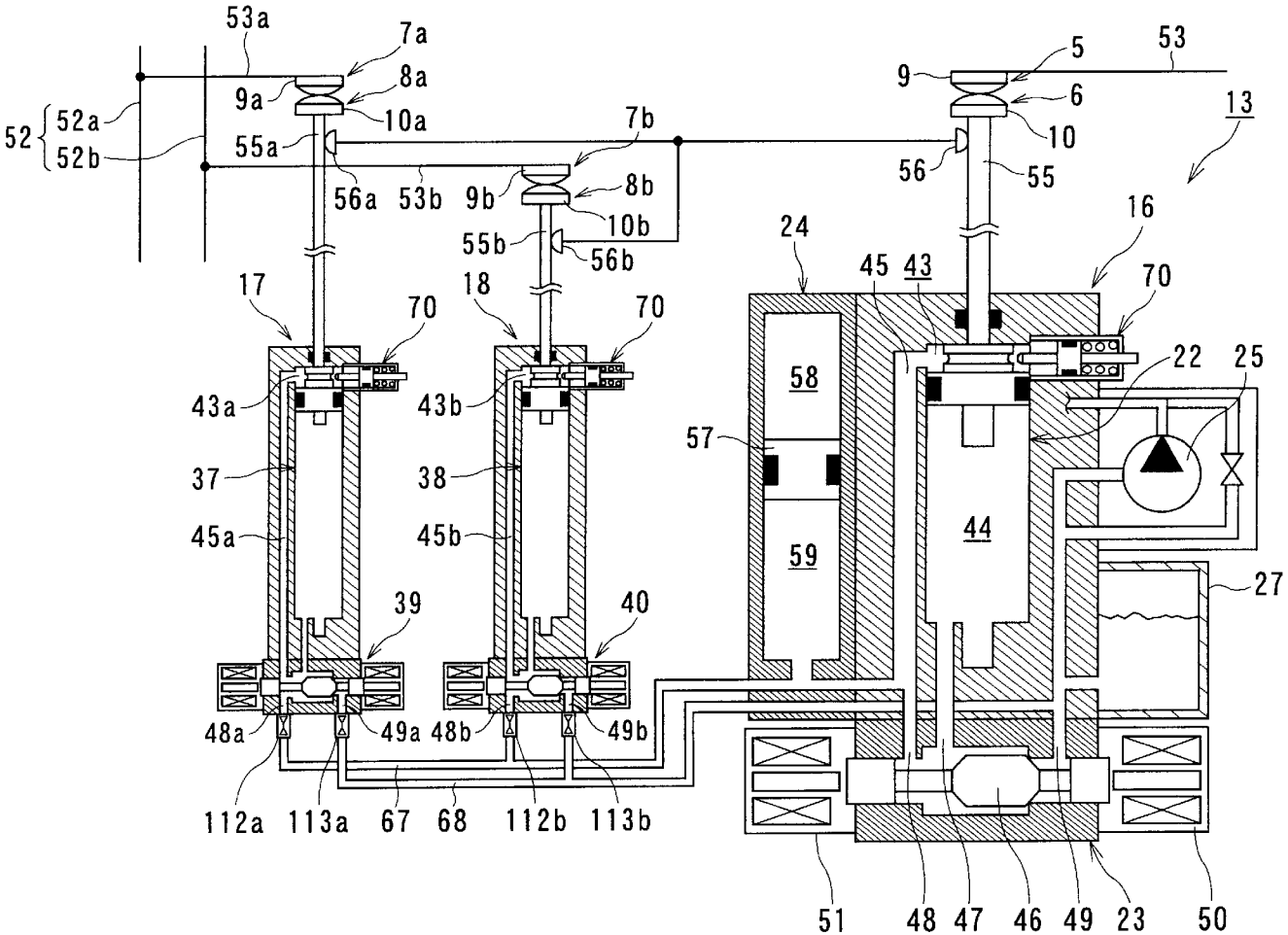
FIG. 12 is a view schematically showing a fluid pressure circuit of combined type fluid pressure driving apparatus according to an eighth embodiment of the present invention.
Figure 13:
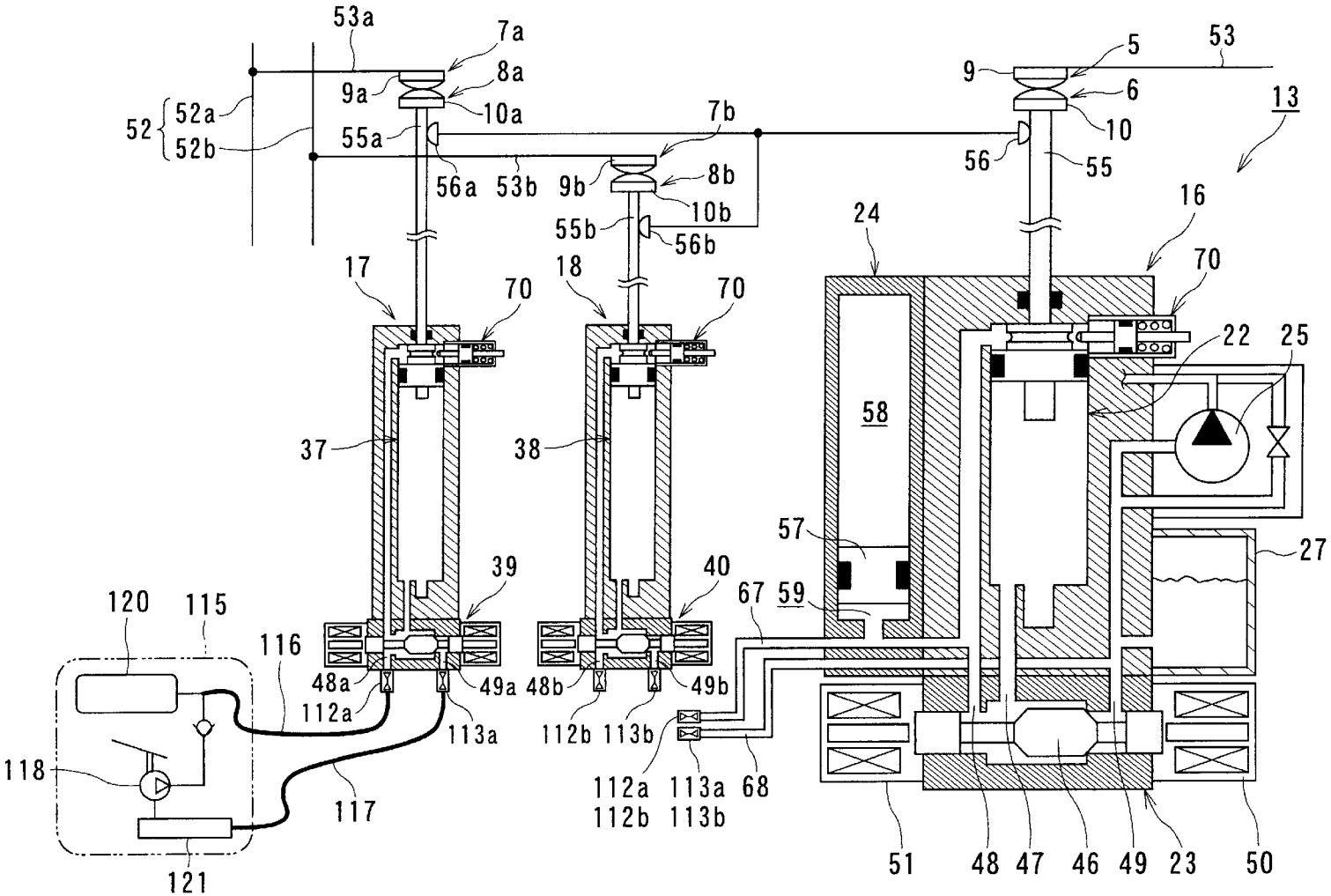
FIG. 13 is a view showing a fluid pressure circuit including an auxiliary fluid pressure source in the eighth embodiment of the present invention.
Figure 14:
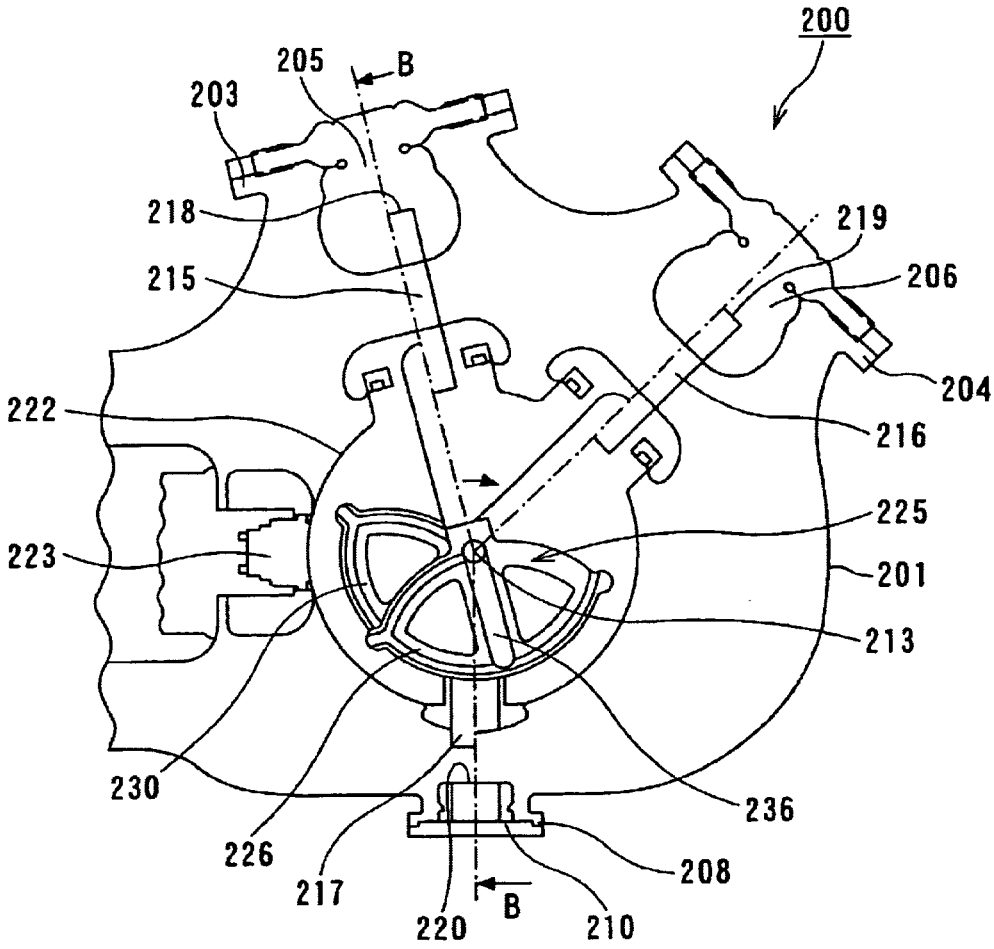
FIG. 14 PRIOR ART
FIG. 14 is a front sectional view showing a disconnecting switch of conventional gas insulated switchgear for electric power.
Figure 15:
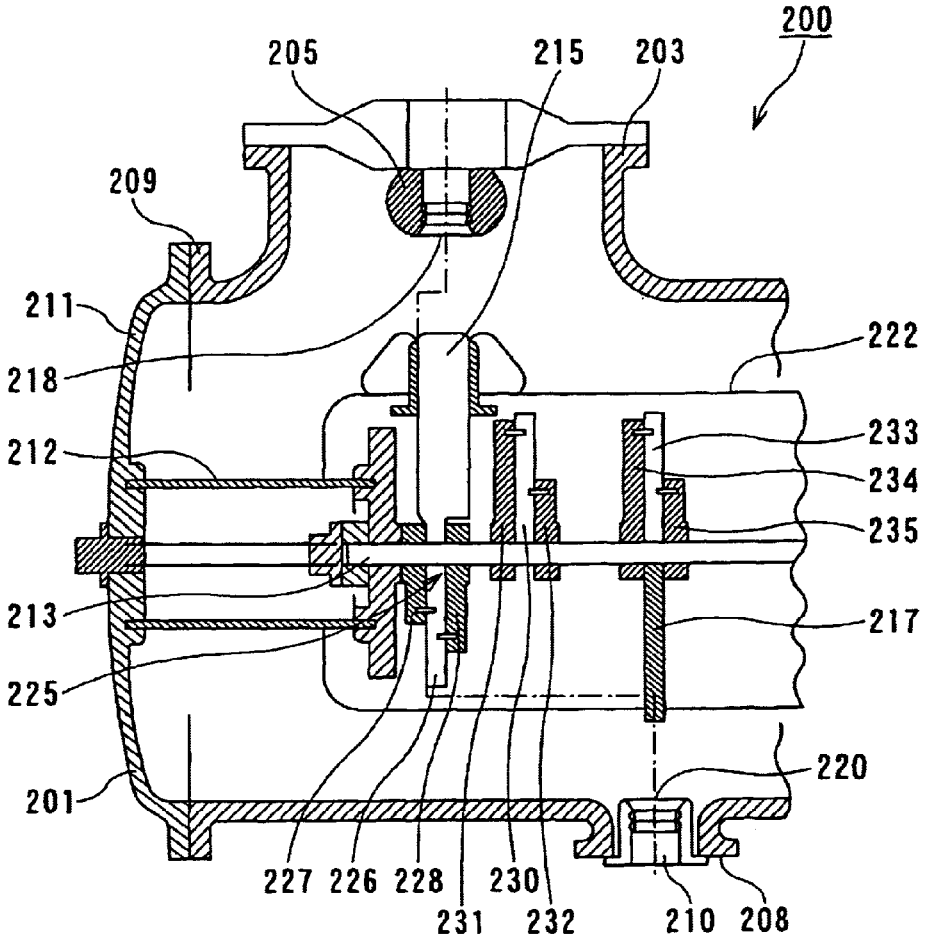
FIG. 15 PRIOR ART
FIG. 15 is a side sectional view taken along a line B—B of the conventional gas insulated switchgear for electric power shown in FIG. 14.

FIG. 12 and FIG. 13 show a combined type fluid pressure driving apparatus according to an eighth embodiment of the present invention.

FIG. 12 is a view schematically showing a fluid pressure circuit of combined type fluid pressure driving apparatus according to the eighth embodiment. The combined type fluid pressure driving apparatus shown in the eighth embodiment is provided with a connector having at least one or more switching valve or check valve. The connector is arranged on the midway of high-pressure and low-pressure fluid passages connecting the circuit-breaker fluid pressure operating section 16 and the disconnecting-switch fluid pressure operating sections 17 and 18 of the fluid pressure operating device 13. In the explanation of the combined type fluid pressure driving apparatus, like reference numerals are used to designate the same components or parts having the same function as the above embodiments, and the details are omitted.

The combined type fluid pressure driving apparatus shown in FIG. 12 is constructed in the following manner. More specifically, like the fluid pressure driving apparatus of the second embodiment, the circuit-breaker fluid pressure operating section 16 and the disconnecting-switch fluid pressure operating sections 17 and 18 are connected by the high-pressure pipe 67 and the low-pressure pipe 68, and then, connectors 112*a,* 112*b;* 113*a,* 113*b* with check valve are provided on the midway. The high-pressure pipe 67 and the low-pressure pipe 68 are formed of a flexible pipe, for example, a flexible hose. The connector 112*a* attached to the hose end portion of the high-pressure pipe 57 and the connector 112*a* attached to the fluid feed port 48*a* of the fluid pressure control valve 39 are removable by one touch.

According to this eighth embodiment, the effect is exhibited in the case where the fluid pressure of combined type fluid pressure driving apparatus is reduced, and as a result, the driving apparatus falls into no-operating state.

For example, in the case where fluid-tightness is worse in the disconnecting-switch fluid pressure operating section 17, it is possible to separate the disconnecting-switch fluid pressure operating section 17 having failure from the fluid pressure circuit. In other words, the high-pressure pipe 67 and the low-pressure pipe 68 are both removed from the fluid pressure control valve 39 together with the connectors 112*a* and 113*a*. In this case, the check valve is attached to these connectors 112*a* and 113*a,* and thereby, it is possible to prevent the working fluid from flowing into the outside, and to keep the fluid-tightness of the portion. Further, it is possible to remove only disconnecting-switch fluid pressure operating section 17 in order to carry out the inspection and repair work, and to replace it with a new component. If necessary, it is possible to continue operating the circuit-breaker fluid pressure operating section 16 and the disconnecting-switch fluid pressure operating section 17 still having preferable function.

On the other hand, FIG. 13 shows a fluid pressure circuit in the following case. More specifically, a failure happens in the circuit-breaker fluid pressure operating section 16, the accumulator 24 and the pump 25, and the connection with the disconnecting-switch fluid pressure operating section 17, 18 is disconnected. Thereafter, a high-pressure hose 116 and a low-pressure hose 117 of an auxiliary fluid pressure source 115 are connected to the connectors 112*a* and 113*a* of the disconnecting-switch fluid pressure operating section 17, respectively.

As shown in FIG. 13, the auxiliary fluid pressure source 115 is connected from the outside, and thereby, it is possible to recover the fluid pressure of the combined type fluid pressure driving apparatus even if a failure happens in the disconnecting-switch fluid pressure operating section 17, the accumulator 24 and the pump 25.

Further, the auxiliary fluid pressure source 115 includes at least electrically operated or manual pump 118. As the need arises, an auxiliary accumulator 120 and an auxiliary tank 121 may be added. In particular, in the case of opening the disconnecting switch 7*a,* there is the case where a relatively high-speed operation is required for loop current cutoff. In emergency case, there is a need of previously providing the auxiliary accumulator 120 for storing a certain amount of high-pressure fluid.

In place of the connector, even when the switching valve is used, the same effect as above can be obtained. In particular, in the case of the switching valve, the fluid passage for connecting the circuit-breaker fluid pressure operating section 16 with the disconnecting-switch fluid pressure operating section 17 is not limited to a flexible pipe, and may be the fluid passage formed in the block as shown in FIG. 4.

According this eighth embodiment, the following effect can be obtained even if the fluid pressure of combined type fluid pressure driving apparatus is reduced, and as a result, the driving apparatus falls into no-operating state. More specifically, it is possible to provide the combined type fluid pressure driving apparatus, which can readily perform various works such as inspection and repair of the fluid pressure operating section, replacement work and recovery work of fluid pressure without stopping the transmission line.

[Other embodiments]

The first to eighth embodiments of the present invention have been described above. The present invention is not limited to the above embodiments. For example, the configuration described in the third to fifth embodiments may be combined and applied.

According to the embodiment, it is possible to further improve safety. In the above embodiments, the insulating switch 1 has been described as target. The present invention is applicable to a small-size switchgear receiving the contact of the circuit breaker and the disconnecting switch in the metal container, and not the porcelain tube, and the same operation and effect as above can be obtained.

As is evident from the above description, according to the present invention, in the combined type fluid pressure driving apparatus, each contact of both circuit breaker and disconnecting switches and the circuit breaker is switched and driven by the fluid pressure drive. By doing so, it is possible to provide a switchgear, which can achieve miniaturization and simplification while securing high operation reliability, and excellent in assembly, operability and inspection, and further, has a compact size.

What is claimed is:

1. A combined type fluid pressure driving apparatus comprising:

a metal container including a hollow support insulator and a plurality of hollow receiving insulators, wherein said metal container, hollow support insulator, and hollow receiving insulators are sealed with insulating gas;

circuit breaker and disconnecting switches each having a stationary electrode fixed in each of the hollow receiving insulators and a movable electrode accommodated therein so as to be separated from or contacted to the stationary electrode, said circuit breaker and disconnecting switches having contacts, respectively;

insulated operating rods accommodated in the hollow support insulator and operatively connected to the movable electrodes of the circuit breaker and the disconnecting switches;

a mechanical box arranged at an end of the hollow support insulator;

a fluid pressure operating device received in the mechanical box and driven by fluid pressure, said fluid pressure operating device comprising: a plurality of fluid pressure cylinders switching and driving the contacts of the circuit breakers and the disconnecting switches, respectively; a plurality of fluid pressure control valves for independently driving the fluid pressure cylinders; an accumulator for storing a high-pressure working fluid supplied commonly to the fluid pressure cylinders and fluid pressure control valves; a pump for supplying the high-pressure working fluid into the accumulator; and a tank for storing a low-pressure fluid discharged from the fluid pressure cylinders; and a connecting mechanism disposed in the metal container, wherein an operating force of the fluid pressure operating device is transmitted to the movable electrodes of the circuit breakers and the disconnecting switches through the insulation operating rods and the connecting mechanism so that each contact of the circuit breaker and the disconnecting switches is switched.

2. The combined type fluid pressure driving apparatus according to claim 1, wherein the fluid pressure operating device further includes: a circuit-breaker fluid pressure operating section for switching and driving a contact of the circuit breaker; a disconnecting-switch fluid pressure operating section for switching and driving a contact of the disconnecting switch; and a manifold forming the fluid pressure cylinder at the circuit-breaker fluid pressure operating section, and the manifold is removably attached with the accumulator, the pump, the low-pressure tank and the disconnecting-switch fluid pressure operating section.

3. The combined type fluid pressure driving apparatus according to claim 1, wherein the fluid pressure operating device includes: a circuit-breaker fluid pressure operating section for switching and driving a contact of the circuit breaker; a disconnecting-switch fluid pressure operating section for switching and driving a contact of the disconnecting switch, and the circuit-breaker fluid pressure operating section and the disconnecting-switch fluid pressure operating section are connected with each other as a fluid pipe.

4. The combined type fluid pressure driving apparatus according to claim 1, wherein the apparatus is provided with a piston holding mechanism, which holds a position of fluid pressure piston sliding in each of the fluid pressure cylinders when the high-pressure working fluid of the accumulator is lost.

5. The combined type fluid pressure driving apparatus according to claim 1, wherein the driving apparatus further includes: a driving rod extending from a fluid pressure piston fixed integrally with a flange; an expansible rod mechanism for expansibly connecting a support member fixed in the mechanical box with the flange; and an elastic element for elastically holding a position of the fluid pressure piston by an operating rod of the expansible rod mechanism.

6. The combined type fluid pressure driving apparatus according to claim 1, wherein the driving rod extending from the fluid pressure piston and a support bracket fixed in the mechanical box are individually formed with an attachment hole aligned with each other, and a lock pin is inserted into the attachment hole aligned, and thereby, a mechanism for holding the position of the fluid pressure piston is constructed.

7. The combined type fluid pressure driving apparatus according to claim 1, wherein the fluid pressure operating device includes: a circuit-breaker fluid pressure operating section for switching and driving a contact of the circuit breaker; and a disconnecting-switch fluid pressure operating section for switching and driving a contact of the disconnecting switch, and a piston rod extending from the fluid pressure piston of the disconnecting-switch fluid pressure operating section is slidable, and a cylinder head fixed to one end of the fluid pressure cylinder is arranged in the mechanical box, and further, the cylinder head is attached with a fluid pressure control valve.

8. The combined type fluid pressure driving apparatus according to claim 1, wherein the fluid pressure operating device includes: a circuit-breaker fluid pressure operating section for switching and driving a contact of the circuit breaker; and a disconnecting-switch fluid pressure operating section for switching and driving a contact of the disconnecting switch, and an outer cylinder is concentrically arranged on an outer side of the fluid pressure cylinder of the disconnecting-switch fluid pressure operating section so as to form a double cylindrical structure, and further, an annular gap between the double cylindrical structure is used as a control fluid passage for feeding and discharging a high-pressure working fluid to and from a cylinder chamber of the fluid pressure cylinder.

9. The combined type fluid pressure driving apparatus according to claim 1, wherein the fluid pressure operating device includes: a circuit-breaker fluid pressure operating section for switching and driving a contact of the circuit breaker; and a disconnecting-switch fluid pressure operating section for switching and driving a contact of the disconnecting switch, and the fluid pressure cylinder of the disconnecting-switch fluid pressure operating section is attached to the cylinder head fixed in the mechanical box, and further, the fluid pressure control valve is arranged on the opposite side of the cylinder head to the fluid pressure cylinder.

10. The combined type fluid pressure driving apparatus according to claim 1, wherein the fluid pressure operating device includes: a circuit-breaker fluid pressure operating section for switching and driving a contact of the circuit breaker; and a disconnecting-switch fluid pressure operating section for switching and driving a contact of the disconnecting switch, and one end of the fluid pressure cylinder of disconnecting-switch fluid pressure operating section is attached to the cylinder head fixed in the mechanical box, and the fluid pressure control valve is provided on the opposite side of the cylinder head to the fluid pressure cylinder while an outer cylinder is concentrically arranged on an outer side of the fluid pressure cylinder of the disconnecting-switch fluid pressure operating section so as to form a double cylindrical structure, and further, an annular gap between the double cylindrical structure is used as a high-pressure fluid passage for always supplying a high-pressure fluid from the accumulator to the cylinder chamber of the fluid pressure cylinder.

11. The combined type fluid pressure driving apparatus according to claim 1, wherein the fluid pressure operating device includes: a circuit-breaker fluid pressure operating section for switching and driving a contact of the circuit breaker; and a disconnecting-switch fluid pressure operating section for switching and driving a contact of the disconnecting switch, and a piston rod extending from the fluid pressure piston of the disconnecting-switch fluid pressure operating section is slidable, and a cylinder head fixed to the fluid pressure cylinder is fixed in the mechanical box, and further, the cylinder head is attached with a fluid pressure control valve so that an operating axis of the fluid pressure control valve and an operating axis of the fluid pressure piston are perpendicular to each other.

12. The combined type fluid pressure driving apparatus according to claim 1, wherein the fluid pressure operating device includes: a circuit-breaker fluid pressure operating section for switching and driving a contact of the circuit breaker; and a disconnecting-switch fluid pressure operating section for switching and driving a contact of the disconnecting switch, and at least one or more switching valve is provided on the midway of high-pressure and low-pressure fluid passages for connecting the circuit-breaker fluid pressure operating section with the disconnecting-switch fluid pressure operating section.

13. The combined type fluid pressure driving apparatus according to claim 1, wherein the fluid pressure operating device includes: a circuit-breaker fluid pressure operating section for switching and driving a contact of the circuit breaker; and a disconnecting-switch fluid pressure operating section for switching and driving a contact of the disconnecting switch, and high-pressure and low-pressure fluid passages for connecting the circuit-breaker fluid pressure operating section with the disconnecting-switch fluid pressure operating section are formed of a flexible pipe, and further, a connector with at least one or more check valve is provided on the midway thereof.

14. The combined type fluid pressure driving apparatus according to claim 1, wherein the fluid pressure operating device includes: a circuit-breaker fluid pressure operating section for switching and driving a contact of the circuit breaker; and a disconnecting-switch fluid pressure operating section for switching and driving a contact of the disconnecting switch, and the circuit-breaker fluid pressure operating section or the disconnecting-switch fluid pressure operating section is connectable with an auxiliary fluid pressure source including at least one or more electrically-operated or manual pump.

15. The combined type fluid pressure driving apparatus according to claim 1, wherein the fluid pressure operating device includes: a circuit-breaker fluid pressure operating section for switching and driving a contact of the circuit breaker; and a disconnecting-switch fluid pressure operating section for switching and driving a contact of the disconnecting switch, and the circuit-breaker fluid pressure operating section or the disconnecting-switch fluid pressure operating section includes an auxiliary fluid pressure source including at least one or more electrically-operated or manual pump, and the auxiliary fluid pressure source is provided with an electrically-operated or manual pump, an auxiliary accumulator for storing a high-pressure fluid and an auxiliary tank for storing a low-pressure fluid.

* * * * *